US011134778B2

(12) United States Patent
LaPointe et al.

(10) Patent No.: US 11,134,778 B2
(45) Date of Patent: Oct. 5, 2021

(54) RECLINING CHAISE

(71) Applicant: La-Z-Boy Incorporated, Monroe, MI (US)

(72) Inventors: Larry P. LaPointe, Temperance, MI (US); John J. Bryson, Athens, TN (US); Jason D. Rains, Evensville, TN (US); Mark D. McClung, Grandview, TN (US)

(73) Assignee: La-Z-Boy Incorporated, Monroe, MI (US)

( * ) Notice: Subject to any disclaimer, the term of this patent is extended or adjusted under 35 U.S.C. 154(b) by 0 days.

(21) Appl. No.: 16/869,648

(22) Filed: May 8, 2020

(65) Prior Publication Data

US 2020/0352333 A1 Nov. 12, 2020

Related U.S. Application Data

(60) Provisional application No. 62/845,580, filed on May 9, 2019.

(51) Int. Cl.
*A47C 1/032* (2006.01)
*A47C 1/034* (2006.01)
(Continued)

(52) U.S. Cl.
CPC ..... *A47C 1/0242* (2013.01); *A47C 7/50* (2013.01); *A47C 7/54* (2013.01)

(58) Field of Classification Search
CPC ..... A47C 1/034; A47C 1/035; A47C 1/0242; A47C 7/50; A47C 7/54
(Continued)

(56) References Cited

U.S. PATENT DOCUMENTS 203,602 A 5/1878 Dietsch
1,182,854 A 5/1916 Poler
(Continued)

FOREIGN PATENT DOCUMENTS

CA 1316807 C 4/1993
CN 87203587 U 1/1988
(Continued)

OTHER PUBLICATIONS

International Search Report and Written Opinion of the International Searching Authority for Application No. PCT/US2006/031852, dated Jun. 17, 2008.
(Continued)

*Primary Examiner* — Rodney B White
(74) *Attorney, Agent, or Firm* — Harness, Dickey & Pierce, P.L.C.

(57) ABSTRACT

A furniture member may include a base frame, a chaise seat bottom frame, and a seatback frame. The chaise seat bottom frame is supported by the base frame and is movable relative to the base frame between first and second positions. The chaise seat bottom frame includes an upper-leg-supporting portion and a lower-leg-supporting portion that are fixed to each other. The lower-leg-supporting portion may support an occupant's lower legs in an extended position relative to the occupant's upper legs. The seatback frame may be supported by the base frame and may be movable relative to the base frame and the chaise seat bottom frame between upright and reclined positions. Movement of the seatback frame from the upright position to the reclined position causes movement of the chaise seat bottom frame upward and forward relative to an aft end of the base frame from the first position to the second position.

18 Claims, 31 Drawing Sheets

(51) Int. Cl.

| | |
|---|---|
| ***A47C 1/035*** | (2006.01) |
| ***A47C 1/0355*** | (2013.01) |
| ***A47C 1/024*** | (2006.01) |
| ***A47C 7/54*** | (2006.01) |
| ***A47C 7/50*** | (2006.01) |

(58) Field of Classification Search
USPC ..... 297/68, 83, 340
See application file for complete search history.

(56) References Cited

U.S. PATENT DOCUMENTS 1,414,637 A 5/1922 Gell
2,473,895 A 6/1949 Mednick
2,677,412 A 5/1954 Thomas
2,719,572 A 10/1955 Goldberg
2,772,723 A 12/1956 Tunnell
3,096,121 A 7/1963 Knabusch et al.
3,179,466 A 4/1965 Garrett
3,191,990 A 6/1965 Rugg et al.
3,302,969 A 2/1967 Mizelle et al.
3,352,601 A 11/1967 Cycowicz
3,567,280 A 3/1971 Bradshaw
3,637,255 A 1/1972 Re
3,638,995 A 2/1972 Flanagan et al.
3,758,151 A 9/1973 Re
3,815,954 A 6/1974 Rogers, Jr. et al.
3,865,432 A 2/1975 Rogers, Jr. et al.
3,880,462 A 4/1975 Mednick
3,926,472 A 12/1975 Evans
3,941,417 A 3/1976 Re
3,945,449 A 3/1976 Ostrow
4,077,663 A * 3/1978 Cycowicz ..... A47C 1/0352 297/83 X
4,099,776 A 7/1978 Crum et al.
4,140,342 A 2/1979 Jones
4,179,157 A 12/1979 Shoemaker et al.
4,212,494 A 7/1980 Dabney
4,212,495 A * 7/1980 Gall ..... A47C 1/0352 297/68 X
4,216,991 A 8/1980 Holobaugh
4,216,992 A 8/1980 Crum
4,226,468 A 10/1980 Johnson
4,226,473 A * 10/1980 Johnson ..... A47C 1/032 297/83 X
4,244,620 A 1/1981 Harrison et al.
4,352,523 A 10/1982 Holobaugh, Jr.
4,364,603 A 12/1982 Johnson
4,367,895 A 1/1983 Pacitti et al.
4,373,602 A 2/1983 Tomita et al.
4,451,084 A 5/1984 Seeley
4,492,407 A 1/1985 Broadhead
4,519,647 A 5/1985 Rogers, Jr.
4,570,996 A 2/1986 Rogers, Jr.
4,582,435 A 4/1986 Davis
4,586,749 A * 5/1986 Nakatani ..... A47C 1/06 297/330
4,601,513 A 7/1986 Pine
4,650,211 A 3/1987 Tanahashi
4,662,597 A 5/1987 Uecker et al.
4,740,031 A 4/1988 Rogers, Jr.
4,805,960 A 2/1989 Tacker
4,818,018 A * 4/1989 Yamasaki ..... A47C 1/032 297/340 X
4,861,101 A 8/1989 Hartline
4,895,411 A 1/1990 Pine
4,915,444 A * 4/1990 Rogers, Jr. ..... A47C 1/0355 297/68 X
4,932,927 A 6/1990 Fillar
4,989,914 A 2/1991 Pine
5,011,220 A 4/1991 LaPointe
5,044,692 A 9/1991 Tidwell, Jr. et al.
5,054,850 A 10/1991 Pine
5,064,244 A 11/1991 Sproule
5,072,988 A 12/1991 Plunk
5,088,789 A 2/1992 LaPointe et al.
5,123,705 A 6/1992 Johnson
5,129,701 A 7/1992 Pine
5,141,284 A 8/1992 LaPointe
5,147,108 A 9/1992 LaPointe
5,156,441 A 10/1992 Byersmith et al.
5,171,000 A 12/1992 LaPointe et al.
5,217,276 A 6/1993 LaPointe et al.
5,234,253 A 8/1993 LaPointe et al.
5,238,295 A 8/1993 Harrell
5,271,660 A 12/1993 LaPointe et al.
5,312,153 A 5/1994 Lin
5,323,526 A 6/1994 Saul et al.
5,328,235 A 7/1994 Saul et al.
5,348,367 A * 9/1994 Mizelle ..... A47C 1/035 297/83 X
5,360,255 A 11/1994 Cook et al.
5,423,591 A 6/1995 LaPointe et al.
5,435,621 A 7/1995 Komorowski et al.
5,435,622 A 7/1995 Fay et al.
5,480,209 A 1/1996 May
5,480,213 A 1/1996 Sproule
5,503,453 A 4/1996 Saul et al.
5,527,095 A 6/1996 Marshall et al.
5,567,009 A 10/1996 Fay et al.
5,570,927 A 11/1996 LaPointe et al.
5,570,930 A 11/1996 LaPointe et al.
5,582,457 A 12/1996 Komorowski et al.
5,597,209 A 1/1997 Bart et al.
5,664,832 A 9/1997 Stevens et al.
5,765,913 A 6/1998 LaPointe et al.
5,772,278 A 6/1998 Kowalski
5,775,775 A 7/1998 Hoffman
5,806,920 A 9/1998 Blount
5,806,921 A 9/1998 LaPointe et al.
5,823,614 A 10/1998 Johnson et al.
5,857,739 A 1/1999 Smith
5,865,457 A 2/1999 Knabusch et al.
5,954,392 A 9/1999 Liss et al.
5,971,475 A 10/1999 Lawson et al.
5,975,627 A 11/1999 LaPointe et al.
5,992,930 A 11/1999 LaPointe et al.
6,000,754 A 12/1999 Lawson
6,030,033 A * 2/2000 Schultz ..... A47C 1/035 297/340
6,145,924 A 11/2000 Mero, Jr. et al.
6,179,328 B1 1/2001 Kawagoe et al.
6,227,489 B1 * 5/2001 Kitamoto ..... B64D 11/00 244/118.5
6,231,120 B1 5/2001 Wiecek
6,309,015 B1 10/2001 Pine
6,330,995 B1 12/2001 Mangeiga et al.
6,409,262 B1 6/2002 LaPointe
6,467,845 B1 10/2002 Chen
6,488,332 B1 12/2002 Markwald
6,491,342 B1 12/2002 Smith
6,655,732 B1 12/2003 LaPointe
6,827,401 B2 12/2004 Marshall et al.
6,939,076 B2 9/2005 LaPointe
6,988,769 B2 1/2006 LaPointe
7,261,367 B2 8/2007 Duncan et al.
7,275,789 B2 10/2007 LaPointe
7,311,359 B2 * 12/2007 Smith ..... A47C 1/022 297/68 X
7,338,132 B2 3/2008 LaPointe
7,357,450 B2 4/2008 Rogers
7,431,387 B2 10/2008 LaPointe et al.
7,475,944 B2 1/2009 Griepentrog et al.
7,552,970 B2 6/2009 LaPointe
7,637,571 B2 12/2009 Okano et al.
7,673,933 B2 3/2010 Lawson
7,731,276 B2 6/2010 Hoffman et al.
7,823,966 B2 * 11/2010 Buchholz ..... A47C 1/0355 297/68 X
7,828,380 B2 11/2010 Olarte
7,850,232 B2 12/2010 Casteel
8,132,855 B2 3/2012 Richard
8,308,228 B2 11/2012 Lawson et al.
8,573,687 B2 11/2013 Lawson et al.

(56) References Cited

U.S. PATENT DOCUMENTS

| | | | | |
|---|---|---|---|---|
| 8,590,964 | B2 | 11/2013 | Murphy et al. | |
| 8,616,627 | B2 | 12/2013 | Murphy et al. | |
| 8,622,467 | B2 | 1/2014 | Murphy et al. | |
| 8,696,054 | B2 | 4/2014 | Crum | |
| 9,314,101 | B2 | 4/2016 | Harwood et al. | |
| 9,357,847 | B2 | 6/2016 | Murphy | |
| 9,433,295 | B2 | 9/2016 | Crum | |
| 9,635,943 | B2 | 5/2017 | Lawson | |
| 9,655,450 | B2 | 5/2017 | Marshall et al. | |
| 9,655,451 | B2 | 5/2017 | Harwood et al. | |
| 9,808,090 | B2 | 11/2017 | Carrera | |
| 9,986,832 | B2 | 6/2018 | LaPointe et al. | |
| 9,986,835 | B2 | 6/2018 | LaPointe et al. | |
| 10,092,106 | B2 | 10/2018 | LaPointe et al. | |
| 10,512,332 | B2 | 12/2019 | LaPointe et al. | |
| 10,524,574 | B2 | 1/2020 | LaPointe et al. | |
| 10,524,575 | B2 | 1/2020 | LaPointe | |
| 10,537,178 | B2 | 1/2020 | Marshall et al. | |
| 10,568,428 | B2 | 2/2020 | Marshall et al. | |
| 10,750,870 | B2 | 8/2020 | Marshall et al. | |
| 10,779,653 | B2 | 9/2020 | LaPointe et al. | |
| 10,820,708 | B2 | 11/2020 | LaPointe et al. | |
| 2001/0026088 | A1 | 10/2001 | Robinson | |
| 2003/0057743 | A1 | 3/2003 | May | |
| 2004/0000803 | A1 | 1/2004 | Guillot et al. | |
| 2005/0035632 | A1* | 2/2005 | Tseng | A47C 1/0355 297/83 |
| 2005/0067867 | A1 | 3/2005 | May | |
| 2006/0061147 | A1 | 3/2006 | Johnson et al. | |
| 2006/0103202 | A1 | 5/2006 | Maki et al. | |
| 2006/0249992 | A1 | 11/2006 | LaPointe et al. | |
| 2006/0249993 | A1 | 11/2006 | Rogers | |
| 2007/0040419 | A1 | 2/2007 | LaPointe et al. | |
| 2007/0085395 | A1 | 4/2007 | LaPointe | |
| 2007/0241589 | A1 | 10/2007 | LaPointe | |
| 2008/0129006 | A1 | 6/2008 | Johnson et al. | |
| 2008/0150329 | A1 | 6/2008 | Lawson | |
| 2009/0284054 | A1 | 11/2009 | Humer et al. | |
| 2011/0016627 | A1 | 1/2011 | Blevins et al. | |
| 2011/0175426 | A1 | 7/2011 | Lawson | |
| 2011/0233972 | A1 | 9/2011 | Weicek | |
| 2011/0248544 | A1 | 10/2011 | Adams et al. | |
| 2011/0248547 | A1 | 10/2011 | LaPointe et al. | |
| 2011/0304193 | A1 | 12/2011 | Murphy et al. | |
| 2012/0193946 | A1 | 8/2012 | Robertson | |
| 2013/0062914 | A1 | 3/2013 | Marshall et al. | |
| 2013/0140855 | A1 | 6/2013 | Murphy et al. | |
| 2013/0140856 | A1 | 6/2013 | Murphy et al. | |
| 2013/0175847 | A1 | 7/2013 | Lawson | |
| 2014/0049079 | A1 | 2/2014 | Lawson et al. | |
| 2014/0049084 | A1 | 2/2014 | Lawson et al. | |
| 2014/0070585 | A1 | 3/2014 | LaPointe | |
| 2014/0103688 | A1 | 4/2014 | Wilson | |
| 2014/0246819 | A1 | 9/2014 | Harwood et al. | |
| 2014/0312660 | A1 | 10/2014 | Natuzzi et al. | |
| 2014/0333099 | A1 | 11/2014 | Lu et al. | |
| 2014/0368011 | A1 | 12/2014 | LaPointe | |
| 2015/0196123 | A1 | 7/2015 | Buehrer | |
| 2015/0250320 | A1 | 9/2015 | Arceci et al. | |
| 2015/0272329 | A1 | 10/2015 | Lawson | |
| 2015/0282619 | A1 | 10/2015 | Lawson | |
| 2016/0058195 | A1 | 3/2016 | Huang et al. | |
| 2016/0100687 | A1 | 4/2016 | Murphy et al. | |
| 2016/0192779 | A1 | 7/2016 | Harwood et al. | |
| 2016/0206097 | A1 | 7/2016 | Rivera | |
| 2016/0270537 | A1 | 9/2016 | Marshall et al. | |
| 2016/0302573 | A1 | 10/2016 | Garland et al. | |
| 2016/0325838 | A1 | 11/2016 | Erhel | |
| 2016/0376007 | A1 | 12/2016 | Meindlhumer | |
| 2017/0013961 | A1 | 1/2017 | LaPointe et al. | |
| 2017/0042330 | A1 | 2/2017 | Bruce et al. | |
| 2017/0101188 | A1 | 4/2017 | Auge et al. | |
| 2017/0150818 | A1 | 6/2017 | Contreras | |
| 2017/0347796 | A1 | 12/2017 | LaPointe et al. | |
| 2017/0367483 | A1 | 12/2017 | Fecker et al. | |
| 2018/0070725 | A1 | 3/2018 | LaPointe et al. | |
| 2018/0078039 | A1 | 3/2018 | LaPointe et al. | |
| 2018/0206644 | A1 | 7/2018 | Murphy | |
| 2018/0228290 | A1 | 8/2018 | Kiwak et al. | |
| 2018/0289156 | A1 | 10/2018 | Marshall et al. | |
| 2018/0289157 | A1 | 10/2018 | Marshall et al. | |
| 2018/0289158 | A1 | 10/2018 | Marshall et al. | |
| 2019/0029436 | A1* | 1/2019 | Lin | A47C 1/03272 |
| 2019/0116981 | A1 | 4/2019 | LaPointe et al. | |
| 2019/0313796 | A1 | 10/2019 | LaPointe | |
| 2019/0350362 | A1 | 11/2019 | LaPointe et al. | |
| 2019/0350368 | A1 | 11/2019 | LaPointe et al. | |

FOREIGN PATENT DOCUMENTS

| | | | | |
|---|---|---|---|---|
| CN | 2168480 | Y | 6/1994 | |
| CN | 200976974 | Y | 11/2007 | |
| CN | 104936483 | A | 9/2015 | |
| CN | 105208896 | A | 12/2015 | |
| DE | 623960 | C | 1/1936 | |
| DE | 29707946 | U1 * | 7/1997 | A47C 1/035 |
| EP | 1504697 | A1 | 2/2005 | |
| JP | S53147329 | A | 12/1978 | |
| JP | H04259403 | A | 9/1992 | |
| JP | H08266370 | A | 10/1996 | |
| JP | H1146920 | A | 2/1999 | |
| JP | 2001054443 | A | 2/2001 | |
| JP | 2003070583 | A | 3/2003 | |
| JP | 2003260097 | A | 9/2003 | |
| JP | 2004065507 | A | 3/2004 | |
| JP | 3125308 | U | 9/2006 | |
| JP | 2008132141 | A | 6/2008 | |
| JP | 2012070787 | A | 4/2012 | |
| JP | 2013172804 | A | 9/2013 | |
| JP | 2014147849 | A | 8/2014 | |
| JP | 3198305 | U | 6/2015 | |
| KR | 20060036132 | A | 4/2006 | |
| KR | 100807370 | B1 | 2/2008 | |
| KR | 101245357 | B1 | 3/2013 | |
| TW | 374704 | B | 11/1999 | |
| WO | WO-9611612 | A1 | 4/1996 | |
| WO | WO-2011094478 | A1 | 8/2011 | |
| WO | WO-2012162499 | A1 | 11/2012 | |
| WO | WO-2015066030 | A1 | 5/2015 | |
| WO | WO-2016092248 | A1 | 6/2016 | |
| WO | WO-2017155069 | A1 | 9/2017 | |

OTHER PUBLICATIONS

First Examination Report for New Zealand Application No. 565885, dated Oct. 7, 2009.

International Search Report and Written Opinion of the International Searching Authority for Application No. PCT/US2014/019455, dated May 26, 2014.

International Search Report and Written Opinion of the International Searching Authority for Application No. PCT/US2016/021361, dated May 30, 2016.

International Search Report and Written Opinion of the International Searching Authority for Application No. PCT/US2016/032967, dated Aug. 19, 2016.

International Search Report and Written Opinion of the International Searching Authority for Application No. PCT/US2017/035976, dated Aug. 25, 2017.

International Search Report and Written Opinion of the International Searching Authority for Application No. PCT/US2017/043899, dated Nov. 8, 2017.

First Examination Report for New Zealand Application No. 735460, dated Mar. 2, 2018.

Office Action for Canadian Application No. 2,896,885, dated Mar. 8, 2018.

International Search Report and Written Opinion of the International Searching Authority for Application No. PCT/US2018/025467, dated Jul. 17, 2018.

European Search Report for Application No. 16765435.9, dated Sep. 5, 2018.

(56) References Cited

OTHER PUBLICATIONS

European Search Report for Application No. 18159817.8, dated Sep. 26, 2018.
Office Action for Canadian Application No. 2,896,885, dated Oct. 18, 2018.
European Search Report for Application No. 16824840.9, dated Dec. 7, 2018.
First Examination Report for New Zealand Application No. 738919, dated Mar. 14, 2019.
European Search Report for Application No. 19158581.9, dated May 3, 2019.
International Search Report and Written Opinion of the International Searching Authority for Application No. PCT/US2019/021568, dated Jun. 20, 2019.
First Examination Report for Australian Application No. 2016294155, dated Nov. 21, 2019.
First Examination Report for Indian Application No. 201817001204, dated Jan. 3, 2020.
International Search Report and Written Opinion of the International Searching Authority for Application No. PCT/US2019/064607, dated Mar. 26, 2020.
Office Action for Taiwanese Application No. 106116858, dated Apr. 10, 2020. Translation provided by Lee and Li, Attorneys-at-Law.
First Examination Report for Indian Application No. 201717033062, dated Apr. 24, 2020.
International Search Report and Written Opinion of the International Searching Authority for Application No. PCT/US2020/032159, dated Aug. 14, 2020.
Office Action for Taiwanese Application No. 107109634, dated Apr. 19, 2021. Translation provided by Lee and Li, Attorneys-at-Law.
U.S. Appl. No. 17/034,789, filed Sep. 28, 2020, Larry P. LaPointe et al.

* cited by examiner

RECLINING CHAISE

CROSS-REFERENCE TO RELATED APPLICATIONS

This application claims the benefit of U.S. Provisional Application No. 62/845,580, filed on May 9, 2019. The entire disclosure of the above application is incorporated herein by reference.

FIELD

The present disclosure relates to a motion furniture, and more particularly, to a reclining chaise.

BACKGROUND

This section provides background information related to the present disclosure and is not necessarily prior art.

In furniture (e.g., chaise lounges, chairs, sofas, loveseats, etc.), functionality is often a tradeoff with aesthetic design. That is, the aesthetic design options of many conventional furniture members often limited motion functionality that can be incorporated into the furniture member. The present disclosure provides furniture members that incorporate aesthetics and functionality that are not found in conventional furniture members.

SUMMARY

This section provides a general summary of the disclosure, and is not a comprehensive disclosure of its full scope or all of its features.

The present disclosure provides a furniture member that may include a base frame, a chaise seat bottom frame, and a seatback frame. The chaise seat bottom frame may be supported by the base frame and may be movable relative to the base frame between a first position and a second position. The chaise seat bottom frame may include an upper-leg-supporting portion and a lower-leg-supporting portion that are fixedly attached to each other. The lower-leg-supporting portion may support an occupant's lower legs in an extended position relative to the occupant's upper legs. The seatback frame may be supported by the base frame and may be movable relative to the base frame between an upright position and a reclined position. The seatback frame may be coupled to the base frame by a first link of a linkage. The upper-leg-supporting portion of the chaise seat bottom frame may be coupled to the seatback frame by a second link of the linkage. The second link may be rotatably coupled to the first link. Movement of the seatback frame from the upright position to the reclined position may cause corresponding and simultaneous movement of the chaise seat bottom frame vertically upward and horizontally forward relative to an aft end of the base frame from the first position to the second position.

In some configurations of the furniture member of the above paragraph, the base frame includes an armrest.

In some configurations of the furniture member of either of the above paragraphs, at least a majority of the lower-leg-supporting portion of the chaise seat bottom frame is disposed in front of a front end of the armrest when the chaise seat bottom frame is in the first position and when the chaise seat bottom frame is in the second position.

In some configurations of the furniture member of any one or more of the above paragraphs, the chaise seat bottom frame includes a support rod, and the base frame includes a bracket having an elongated slot that movably receives the support rod. The support rod moves along a length of the slot as the chaise seat bottom frame moves between the first and second positions.

In some configurations of the furniture member of any one or more of the above paragraphs, the chaise seat bottom frame includes an elongated slot that receives a support member attached to the base frame.

In some configurations of the furniture member of any one or more of the above paragraphs, a surface defining the slot slides on the support member as the chaise seat bottom frame moves between the first and second positions.

In some configurations of the furniture member of any one or more of the above paragraphs, the slot has an open first end and a closed second end.

In some configurations of the furniture member of any one or more of the above paragraphs, the chaise seat bottom frame is coupled to the base frame by a swing link that rotates relative to the base frame and the chaise seat bottom frame as the chaise seat bottom frame moves between the first and second positions.

In some configurations of the furniture member of any one or more of the above paragraphs, the chaise seat bottom frame includes a first support rod rotatably coupled to the swing link.

In some configurations of the furniture member of any one or more of the above paragraphs, the base frame includes a second support rod rotatably coupled to the swing link.

In some configurations, the furniture member of any one or more of the above paragraphs includes a motor-driven actuator having a first end attached to the base frame and a second end attached to the chaise seat bottom frame.

In some configurations of the furniture member of any one or more of the above paragraphs, actuation of the motor-driven actuator moves the seatback frame between the upright and reclined positions and moves the chaise seat bottom frame between the first and second positions.

In some configurations of the furniture member of any one or more of the above paragraphs, the motor-driven actuator is a linear actuator (e.g., a telescoping linear actuator).

In some configuration of the furniture member of any one or more of the above paragraphs, the seatback frame is manually driven between the upright and reclined positions and the chaise seat bottom frame is manually driven between the first and second positions.

In some configurations of the furniture member of any one or more of the above paragraphs, the base frame is stationary relative to a ground surface upon which the furniture member is disposed.

In some configurations of the furniture member of any one or more of the above paragraphs, the furniture member can include a tensioning system that provides resistance to movement of the seatback frame between the upright and reclined positions and resistance to movement of the chaise seat bottom frame between the first and second positions.

In some configurations of the furniture member of any one or more of the above paragraphs, the seatback frame is able to be positioned at an infinite number of positions (and maintained at any of the infinite positions) between the upright and reclined positions, and wherein the chaise seat bottom frame is able to be positioned at an infinite number of positions (and maintained at any of the infinite positions) between the first and second positions.

The present disclosure provides a furniture member that may include a base frame, a chaise seat bottom frame, and a seatback frame. The chaise seat bottom frame may be supported by the base frame and may be movable relative to the base frame between a first position and a second position. The chaise seat bottom frame may include an upper-leg-supporting portion and a lower-leg-supporting portion that are fixedly attached to each other. The lower-leg-supporting portion may support an occupant's lower legs in an extended position relative to the occupant's upper legs. The seatback frame may be supported by the base frame and may be movable relative to the base frame and the chaise seat bottom frame between an upright position and a reclined position. Movement of the seatback frame from the upright position to the reclined position causes corresponding and simultaneous movement of the chaise seat bottom frame vertically upward and horizontally forward relative to an aft end of the base frame from the first position to the second position.

In some configurations of the furniture member of the above paragraph, the seatback frame is coupled to the base frame by a first link of a linkage.

In some configurations of the furniture member of either of the above paragraphs, the upper-leg-supporting portion of the chaise seat bottom frame is coupled to the seatback frame by a second link of the linkage.

In some configurations of the furniture member of any one or more of the above paragraphs, the second link is fixed relative to the chaise seat bottom frame.

In some configurations of the furniture member of any one or more of the above paragraphs, the second link is rotatably coupled to the first link.

In some configurations of the furniture member of any one or more of the above paragraphs, the linkage includes a third link that is rotatably coupled to the first link.

In some configurations of the furniture member of any one or more of the above paragraphs, the third link includes a slot that slidably receives a portion of the second link.

In some configurations of the furniture member of any one or more of the above paragraphs, the slot in the third link is a linearly extending slot.

In some configurations of the furniture member of any one or more of the above paragraphs, the base frame includes an armrest.

In some configurations of the furniture member of any one or more of the above paragraphs, at least a majority of the lower-leg-supporting portion of the chaise seat bottom frame is disposed in front of a front end of the armrest when the chaise seat bottom frame is in the first position and when the chaise seat bottom frame is in the second position.

In some configurations of the furniture member of any one or more of the above paragraphs, the chaise seat bottom frame includes a support rod.

In some configurations of the furniture member of any one or more of the above paragraphs, the base frame includes a bracket having an elongated slot that movably receives the support rod.

In some configuration of the furniture member of any one or more of the above paragraphs, the support rod moves along a length of the slot as the chaise seat bottom frame moves between the first and second positions.

In some configurations of the furniture member of any one or more of the above paragraphs, the chaise seat bottom frame includes an elongated slot that receives a support member attached to the base frame. A surface defining the slot slides on the support member as the chaise seat bottom frame moves between the first and second positions.

In some configurations of the furniture member of any one or more of the above paragraphs, the slot has an open first end and a closed second end.

In some configurations of the furniture member of any one or more of the above paragraphs, the chaise seat bottom frame is coupled to the base frame by a swing link that rotates relative to the base frame and the chaise seat bottom frame as the chaise seat bottom frame moves between the first and second positions.

In some configurations of the furniture member of any one or more of the above paragraphs, the chaise seat bottom frame includes a first support rod rotatably coupled to the swing link.

In some configurations of the furniture member of any one or more of the above paragraphs, the base frame includes a second support rod rotatably coupled to the swing link.

In some configurations, the furniture member of any one or more of the above paragraphs includes a motor-driven actuator having a first end attached to the base frame and a second end attached to the chaise seat bottom frame.

In some configurations of the furniture member of any one or more of the above paragraphs, actuation of the motor-driven actuator moves the seatback frame between the upright and reclined positions and moves the chaise seat bottom frame between the first and second positions.

In some configurations of the furniture member of any one or more of the above paragraphs, the seatback frame is manually driven between the upright and reclined positions and the chaise seat bottom frame is manually driven between the first and second positions.

In some configurations of the furniture member of any one or more of the above paragraphs, the motor-driven actuator is a linear actuator (e.g., a telescoping linear actuator).

In some configurations of the furniture member of any one or more of the above paragraphs, the base frame is stationary relative to a ground surface upon which the furniture member is disposed.

In some configurations of the furniture member of any one or more of the above paragraphs, the seatback frame is coupled to the base frame and the chaise seat bottom frame by a linkage that allows movement of the seatback frame between the upright and reclined positions. The linkage may include a first link, a second link, and a third link. The first link may be fixedly attached to the seatback frame and rotatably attached to the chaise seat bottom frame. The second link may be rotatably attached to the chaise seat bottom frame and includes a slot. The third link may be rotatably attached to the base frame and rotatably attached to the first link. The third link may include a protrusion that is slidably received in the slot of the second link.

In some configurations of the furniture member of any one or more of the above paragraphs, the chaise seat bottom frame is coupled to the base frame by a plurality of swing links that rotates relative to the base frame and the chaise seat bottom frame as the chaise seat bottom frame moves between the first and second positions.

In some configurations of the furniture member of any one or more of the above paragraphs, the chaise seat bottom frame is suspended from the base frame on the plurality of swing links such that vertical movement of the weight of the chaise seat bottom frame and the occupant provides a resisting force to balance a recline force of the seatback frame.

In some configurations of the furniture member of any one or more of the above paragraphs, the horizontally forward movement of the chaise seat bottom frame while the seatback is moving toward the recline position also results in forward movement of a bottom end of the seatback while the seatback is moving toward the reclined position.

In some configurations of the furniture member of any one or more of the above paragraphs, the furniture member can include a tensioning system that provides resistance to movement of the seatback frame between the upright and reclined positions and resistance to movement of the chaise seat bottom frame between the first and second positions.

In some configurations of the furniture member of any one or more of the above paragraphs, the seatback frame is able to be positioned at an infinite number of positions (and maintained at any of the infinite positions) between the upright and reclined positions, and wherein the chaise seat bottom frame is able to be positioned at an infinite number of positions (and maintained at any of the infinite positions) between the first and second positions.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
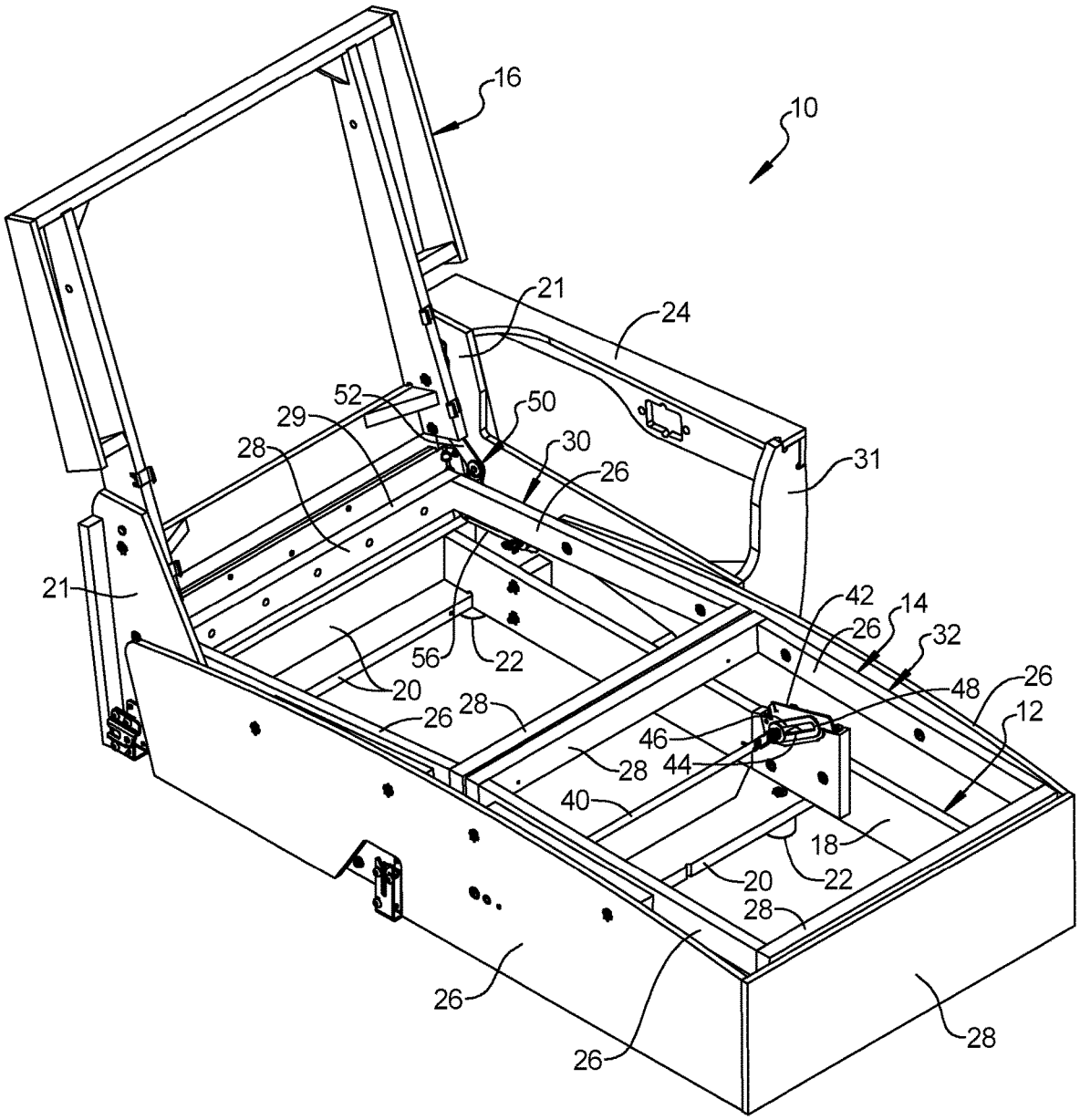
FIG. 1 is a perspective view of a furniture member with a seatback frame in an upright position and a seat bottom frame in a first position according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-8, a furniture member 10 is provided that may include a base frame 12, a chaise seat bottom frame 14, and a seatback frame 16. In some configurations, the furniture member 10 could be a standalone furniture item. In other configurations, the furniture member 10 may be a section of a sectional sofa, for example.

Figure 7:
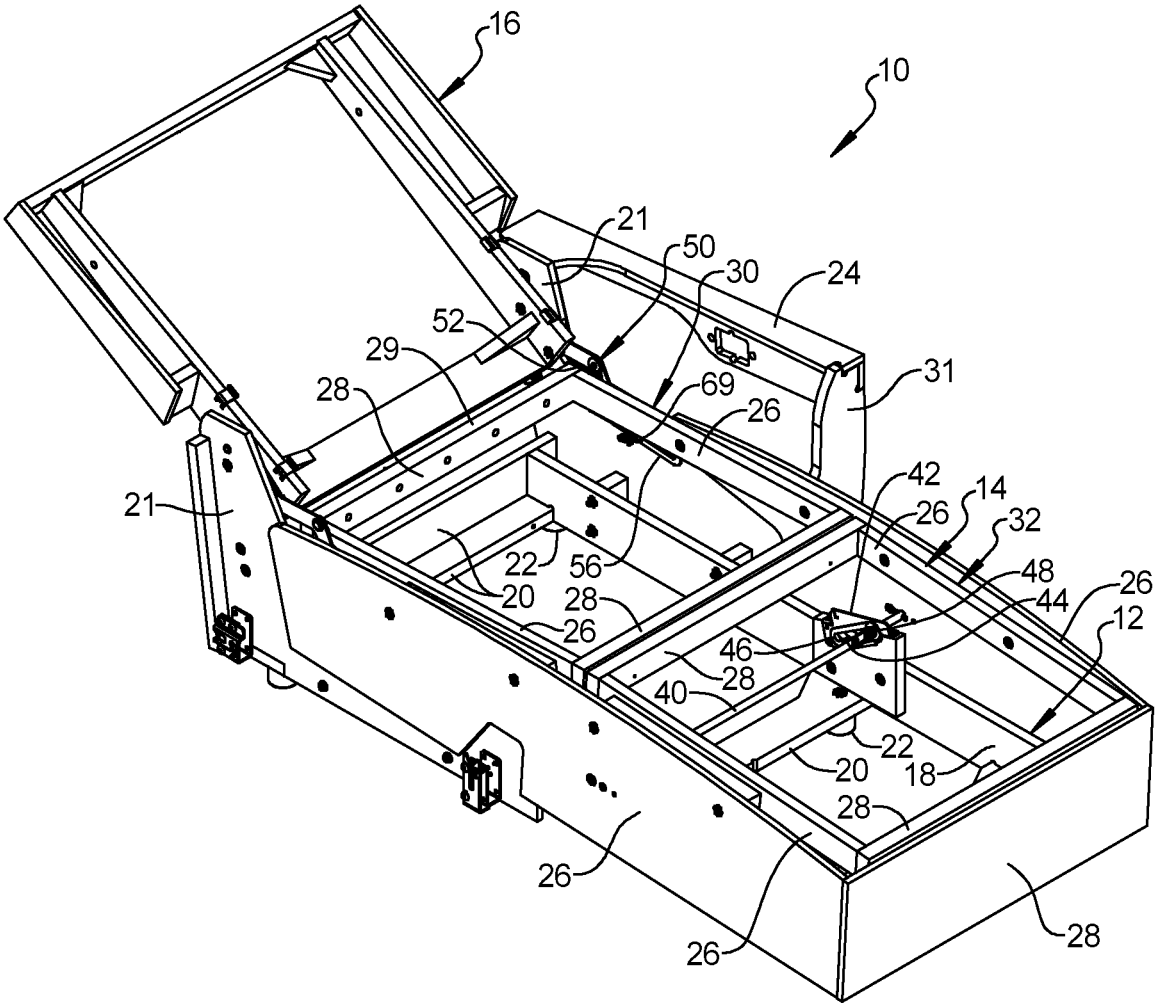
FIG. 7 is a perspective view of the furniture member with the seatback frame in a fully reclined position and the seat bottom frame in a second position.
Figure 8:
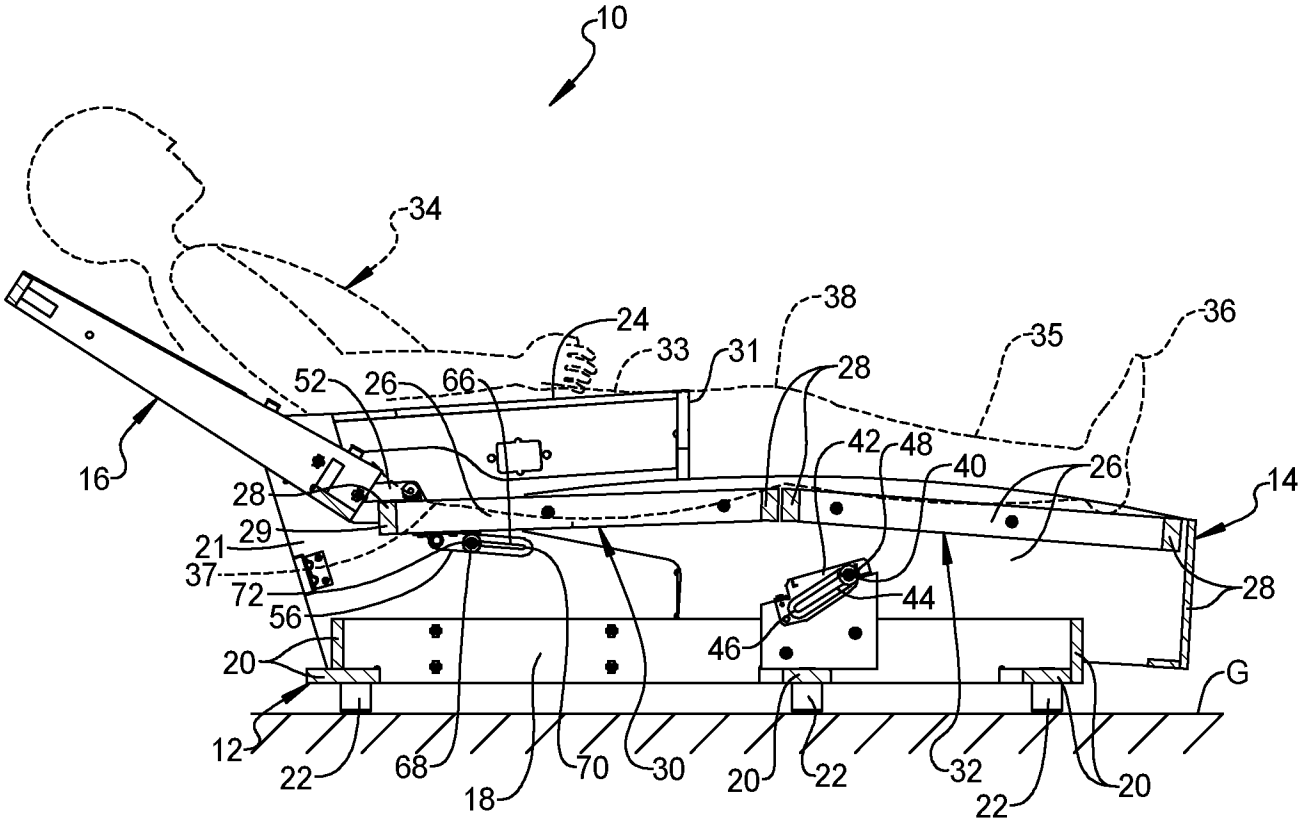
FIG. 8 is a cross-sectional view of the furniture member with the seatback frame in the fully reclined position and the seat bottom frame in the second position.
Figure 9:
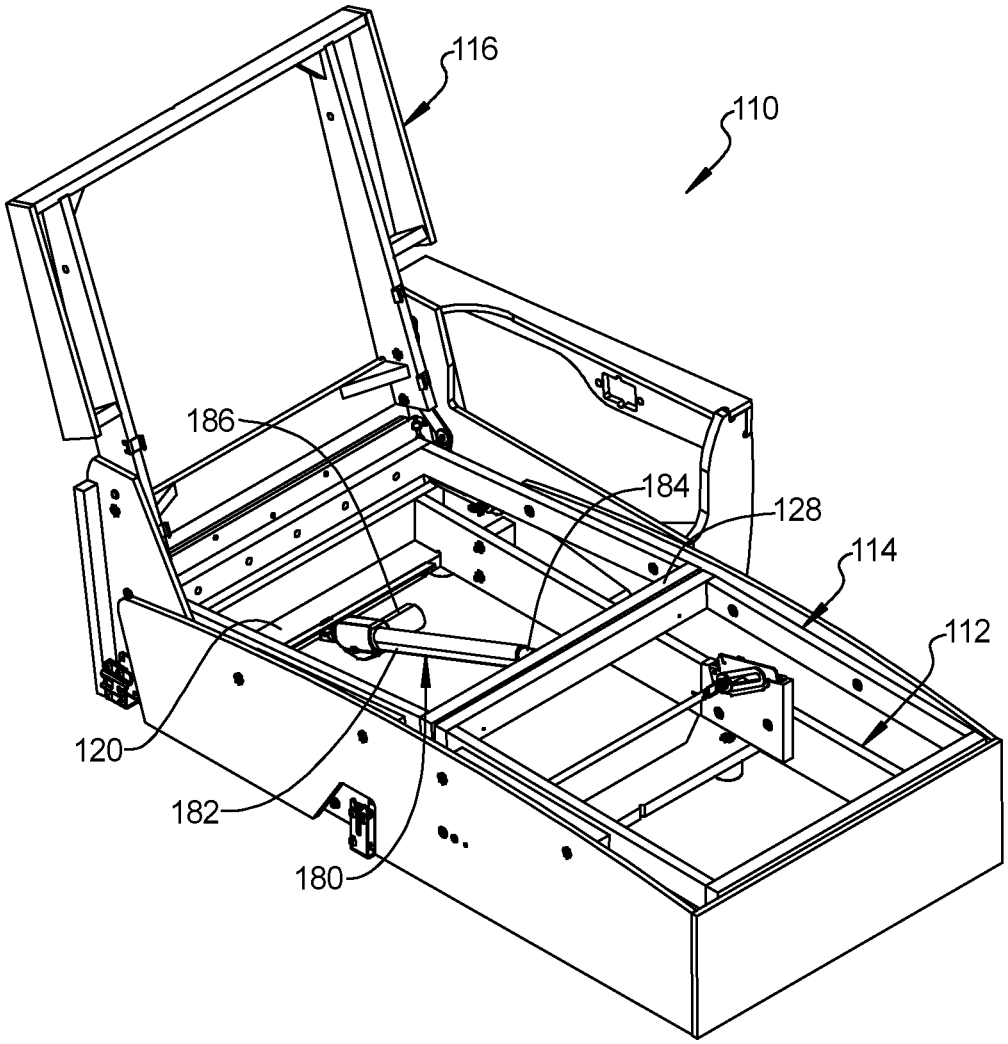
FIG. 9 is a perspective view of another furniture member with a seatback frame in an upright position and a seat bottom frame in a first position.
Figure 10:
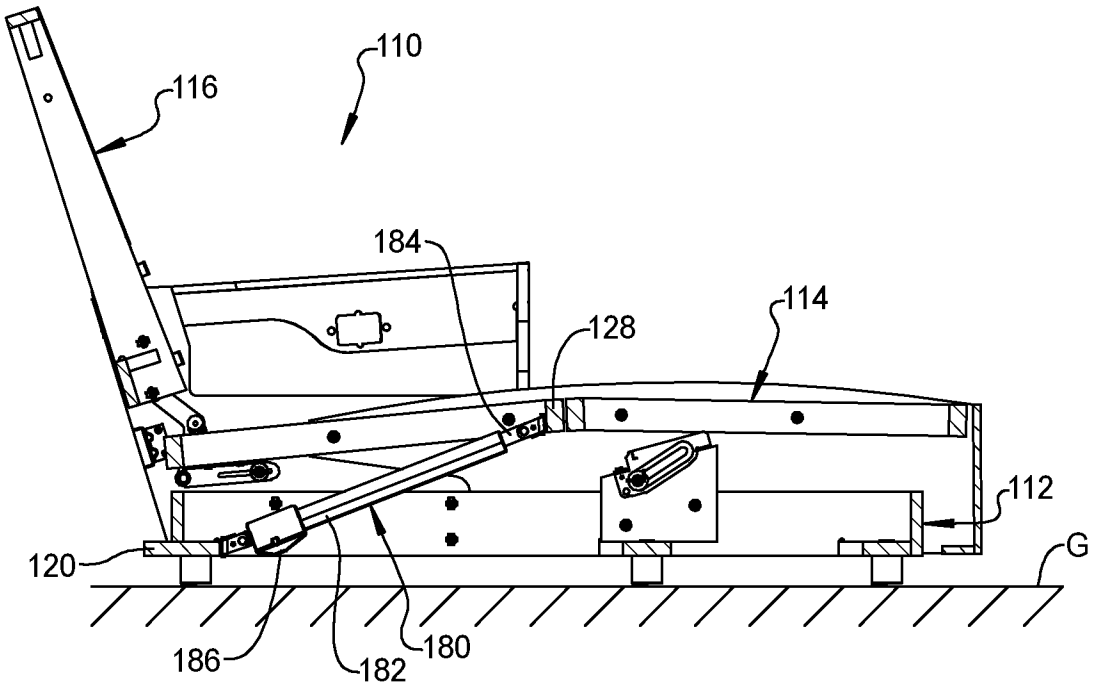
FIG. 10 is a cross-sectional view of the furniture member of FIG. 9 with the seatback frame in the upright position and the seat bottom frame in the first position.

As will be described in more detail below, the seatback frame 16 is movable relative to the base frame 12 and the chaise seat bottom frame 14 between an upright position (FIGS. 1-4) and a fully reclined position (FIGS. 7 and 8). The chaise seat bottom frame 14 is movable relative to the base frame 12 and the seatback frame 16 between a first position (FIGS. 1-4) and a second position (FIGS. 7-8). The second position of the chaise seat bottom frame 14 is vertically upward and horizontally forward relative to the first position. Movement of the seatback frame 16 from the upright position toward the fully reclined position causes corresponding and simultaneous movement of the chaise seat bottom frame 14 from the first position toward the second position. Likewise, movement of the seatback frame 16 toward the upright position causes corresponding and simultaneous movement of the chaise seat bottom frame 14 toward the first position.

Figure 2:
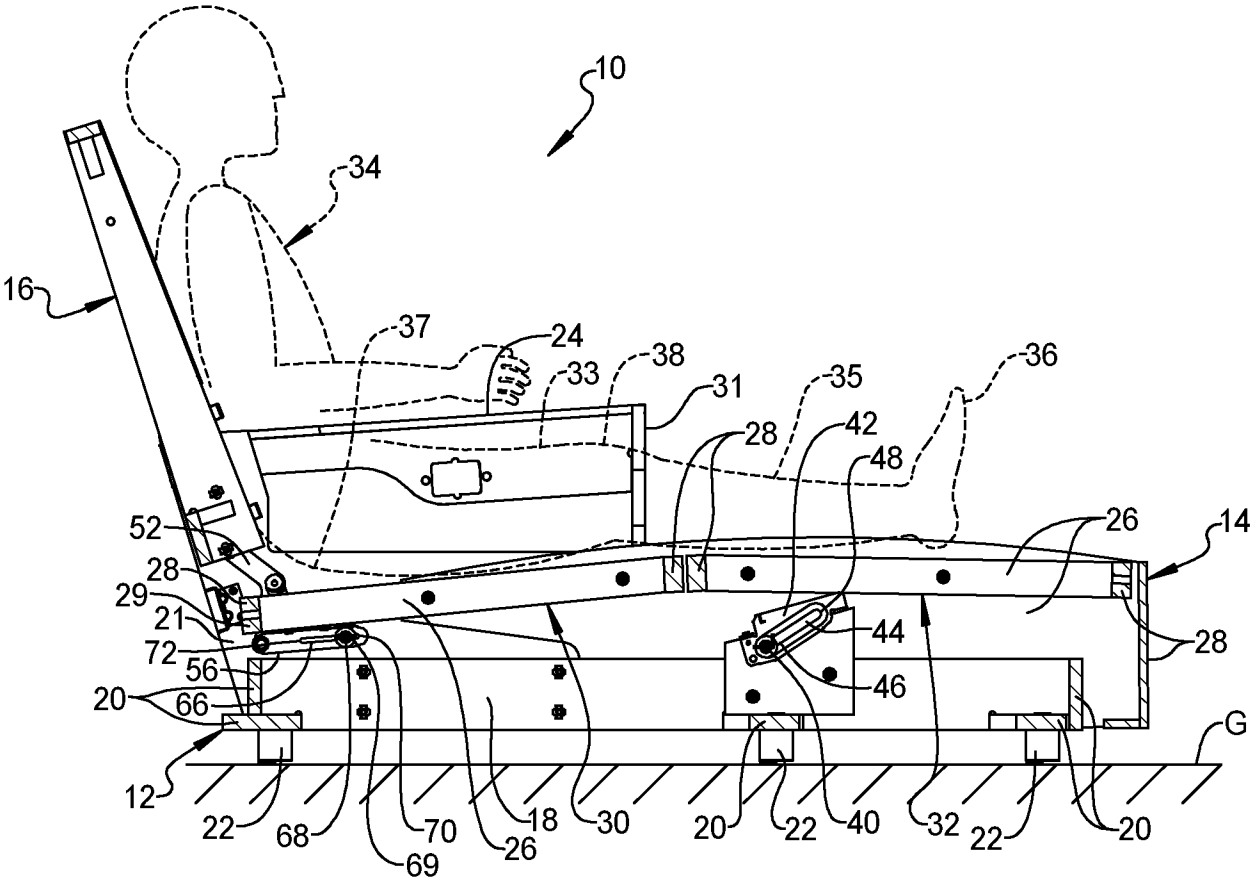
FIG. 2 is a cross-sectional view of the furniture member with the seatback frame in the upright position and the seat bottom frame in the first position.
Figure 3:
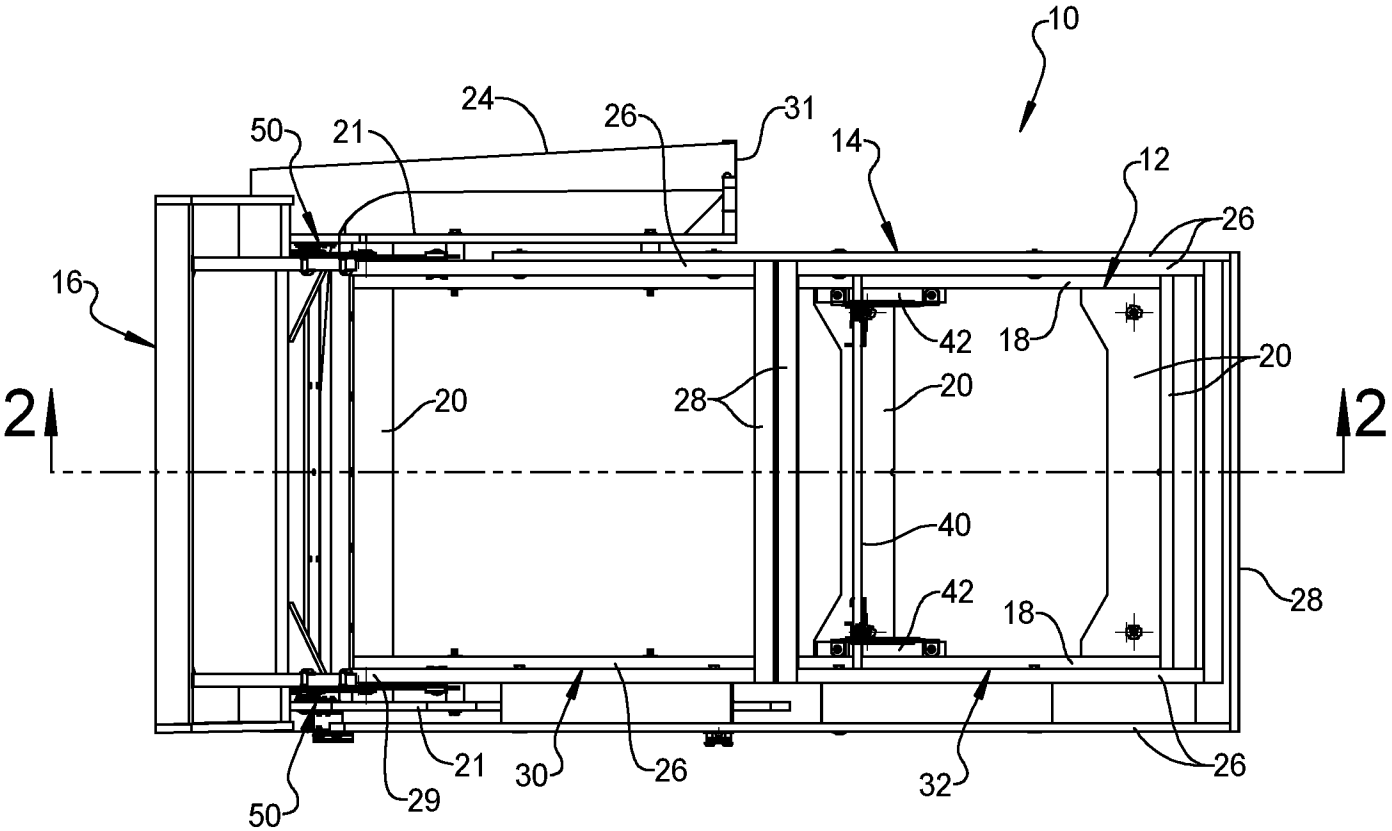
FIG. 3 is a plan view of the furniture member with the seatback frame in the upright position and the seat bottom frame in the first position.

The base frame 12 may be a stationary frame that rests on a ground or floor surface G (FIGS. 2 and 8). The base frame 12 may support the chaise seat bottom frame 14 and the seatback frame 16. In the particular configuration shown in the figures, the base frame 12 includes a plurality of fore-aft extending support beams 18, a plurality of laterally extending support beams 20, and a pair of lateral support members 21. The fore-aft extending support beams 18 may be fixedly attached to the laterally extending support beams 20, and each of the lateral support members 21 may be fixedly attached to one or more of the support beams 18, 20. As shown in FIGS. 2 and 8, feet 22 may be attached to any of the support beams 18, 20 and may contact the ground surface G. The furniture member 10 may include one or more armrests 24 that may be fixedly attached to the lateral support members 21 and/or to one or more support beams 18, 20. In some configurations, the one or more armrests 24 could be attached to and movable with the chaise seat bottom frame 14.

Figure 5:
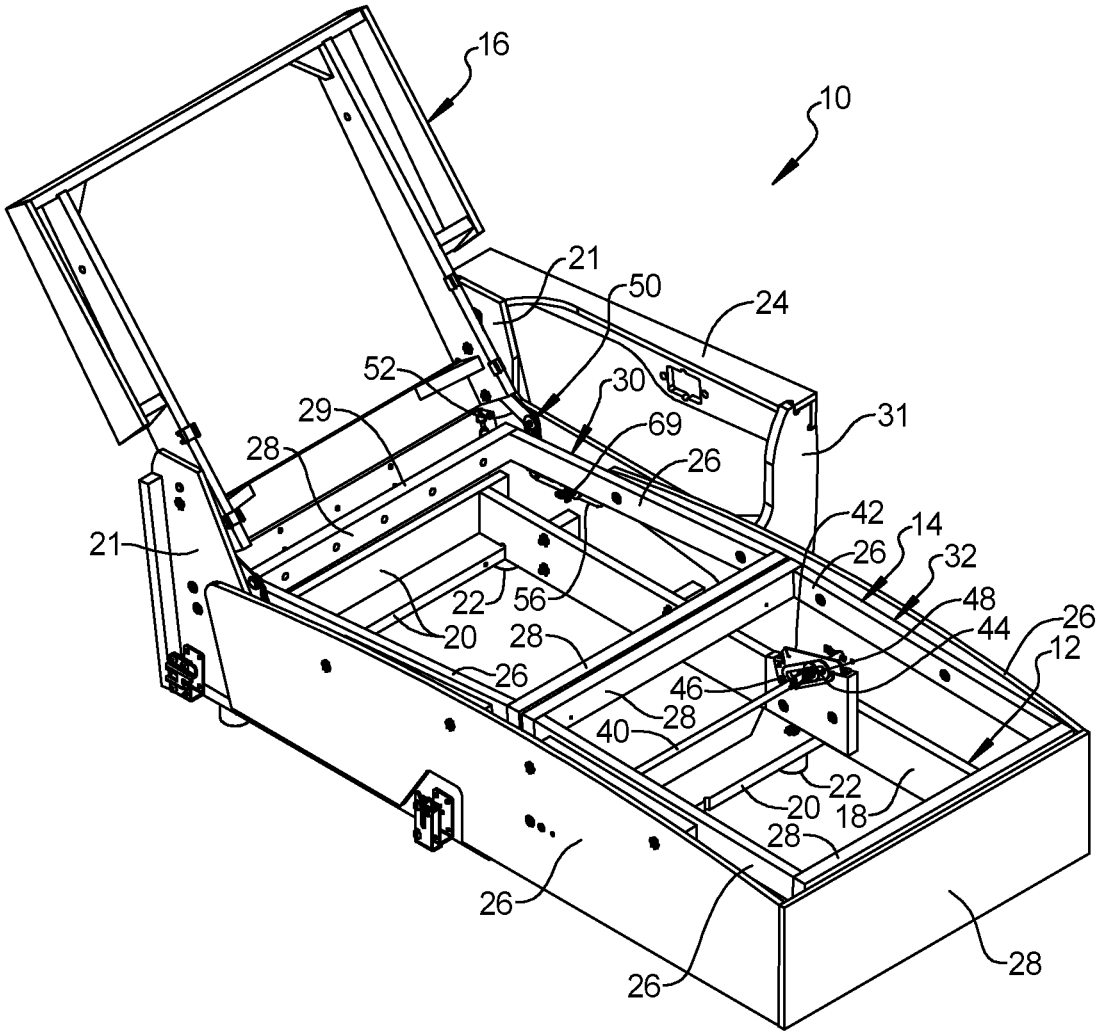
FIG. 5 is a perspective view of the furniture member with the seatback frame in a partially reclined position and the seat bottom frame in an intermediate position.
Figure 6:
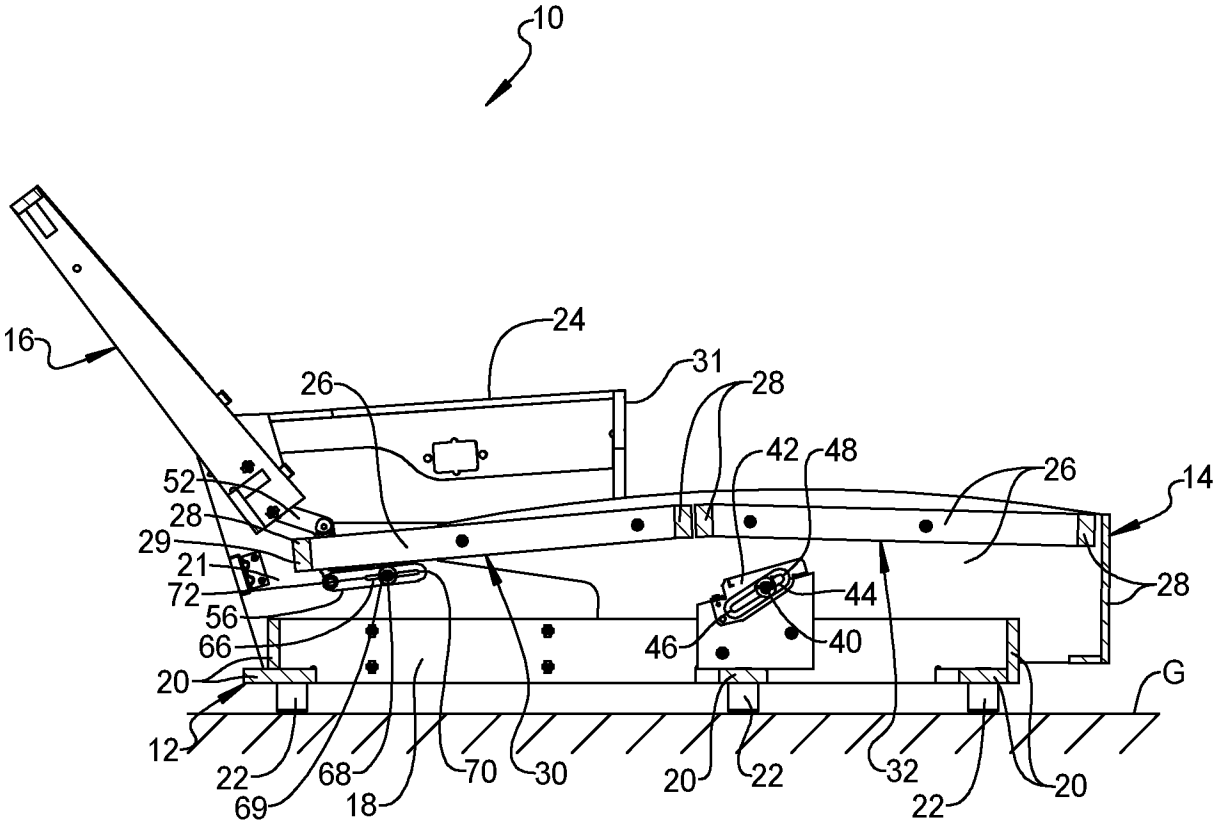
FIG. 6 is a cross-sectional view of the furniture member with the seatback frame in the partially reclined position and the seat bottom frame in the intermediate position.

The chaise seat bottom frame 14 may be supported by the base frame 12 and may be movable relative to the base frame 12 and the seatback frame 16 between the first position (FIGS. 1-4) and the second position (FIGS. 7 and 8). The chaise seat bottom frame 14 can also be moved to a plurality of intermediate positions between the first and second positions (one such intermediate position is shown in FIGS. 5 and 6).

The chaise seat bottom frame 14 may include a plurality of fore-aft extending support beams 26, a plurality of laterally extending support beams 28. In the configurations shown in the figures, all of the support beams 26, 28 are fixed relative to each other. The support beams 26, 28 may define an upper-leg-supporting portion 30 and a lower-leg-supporting portion 32. The upper-leg-supporting portion 30 and lower-leg-supporting portion 32 may be fixed relative to each other (i.e., the upper-leg-supporting portion 30 and the lower-leg-supporting portion 32 are immovable relative to each other). The upper-leg-supporting portion 30 may be an aft portion of the chaise seat bottom frame 14, and the lower-leg-supporting portion 32 may be a forward portion of the chaise seat bottom frame 14. An aft end 29 of the upper-leg-supporting portion 30 may be disposed adjacent the seatback frame 16. At least a majority of the lower-leg-supporting portion 32 is disposed in front of a front end 31 of the armrest(s) 24 when the chaise seat bottom frame 14 is in the first position and when the chaise seat bottom frame 14 is in second first position. As shown in FIG. 2, the upper-leg-supporting portion 30 may support the upper legs 33 (e.g., thighs) and buttocks 37 of an occupant 34 sitting in the furniture member 10. The lower-leg-supporting portion 32 may support the occupant's lower legs 35 (e.g., below the knees 38) and feet 36 in an extended position relative to the occupant's upper legs 33 (i.e., so that the occupant's feet 36 are elevated off of the ground surface G, as shown in FIG. 2) while the chaise seat bottom frame 14 is in the first position and while the chaise seat bottom frame 14 is in second first position. In other words, in all positions of the furniture member 10, the lower-leg-supporting portion 32 supports the occupant's lower legs 35 in an extended position relative to the occupant's upper legs 33.

In some configurations, the chaise seat bottom frame 14 may include a laterally extending support rod 40 attached to and extending between two fore-aft extending support beams 26 that are disposed at opposite lateral sides of the chaise seat bottom frame 14. The base frame 12 may include a pair of brackets 42 disposed at opposite lateral sides of the base frame 12. For example, the brackets 42 may be fixed to and/or extend from respective fore-aft extending support beams 18. The brackets 42 may include elongated slots 44 that movably receive the support rod 40. The brackets 42 support the support rod 40, which in turn, supports the chaise seat bottom frame 14. The slots 44 may be angled such that aft ends 46 of the slots 44 are disposed vertically lower than forward ends 48 of the slots 44. When the chaise seat bottom frame 14 is in the first position (FIGS. 1-4), the support rod 40 is disposed at the aft ends 46 of the slots 44. When the chaise seat bottom frame 14 is in the second position (FIGS. 7 and 8), the support rod 40 is disposed at the forward ends 48 of the slots 44. The support rod 40 slides along lengths of the slots 44 as the chaise seat bottom frame 14 moves between the first and second positions.

The seatback frame 16 may be coupled to the base frame 12 and chaise seat bottom frame 14 by a pair of linkages 50 that allow the seatback frame 16 to move relative to the base frame 12 and the chaise seat bottom frame 14 between the upright position (FIGS. 1-4) and the fully reclined position (FIGS. 7 and 8). The seatback frame 16 can also be moved via the linkages 50 to a plurality of partially reclined or intermediate positions between the first and second positions (one such partially reclined position is shown in FIGS. 5 and 6).

Figure 4:
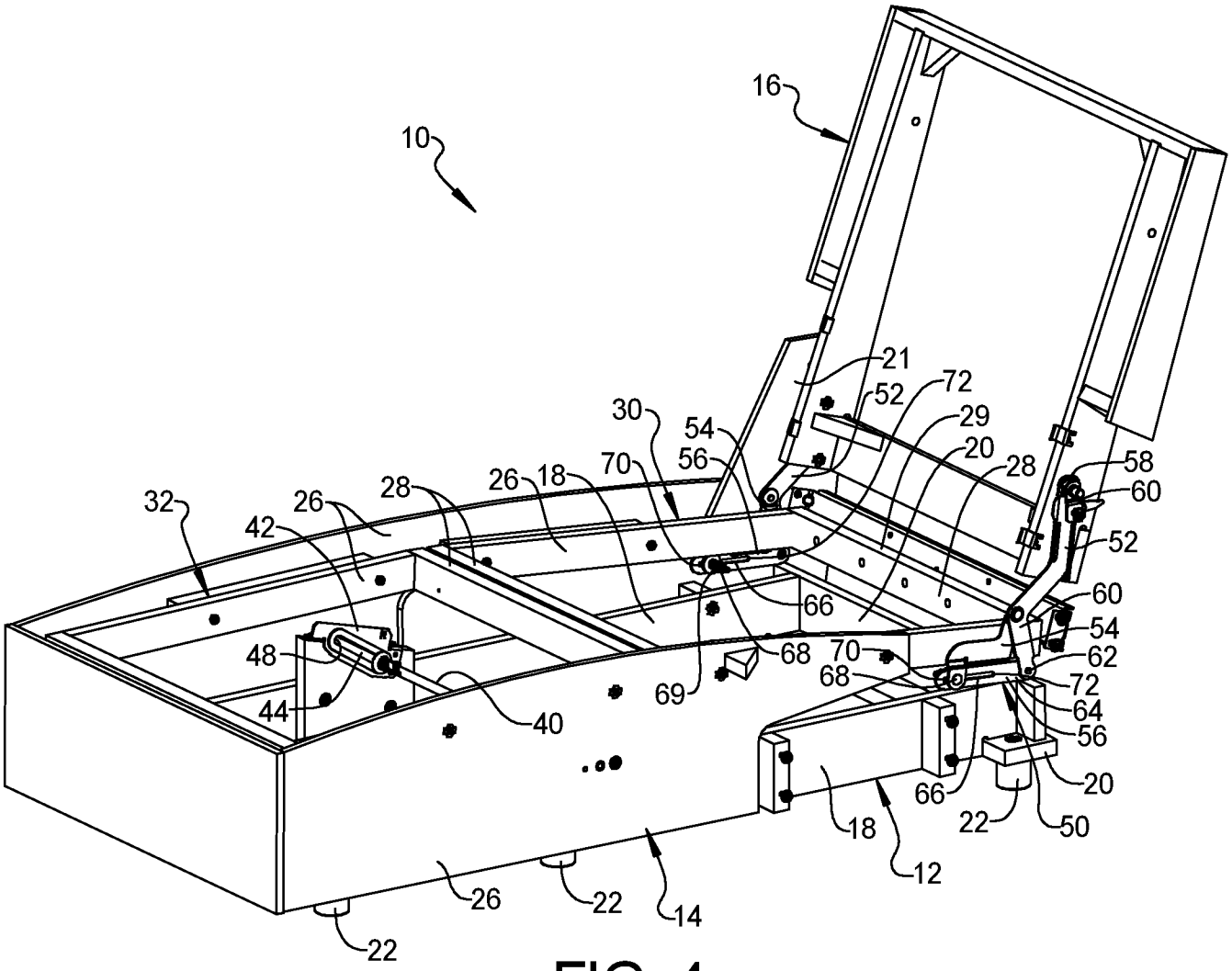
FIG. 4 is a partial perspective view of the furniture member with the seatback frame in the upright position and the seat bottom frame in the first position.

As shown in FIG. 4, each of the linkages 50 may include a first link 52, a second link 54, and a third link 56. The first link 52 may be fixedly attached at a first end 58 to the seatback frame 16. The first end 58 may also be rotatably coupled to the base frame 12 (e.g., the first end 58 of each first link 52 may be rotatably coupled to a respective lateral support member 21 of the base frame 12 or to a bracket 60 fixed to the lateral support member 21). In this manner, the seatback frame 16 is rotatable relative to the base frame 12.

Each of the second links 54 may be fixedly attached to a respective fore-aft support beam 26 of the chaise seat bottom frame 14. An intermediate portion 60 of each first link 52 may be rotatably coupled to a respective one of the second links 54. A second end 62 of each first link 52 may be coupled to a first end 64 of a respective one of the third links 56. Each of the third links 56 may include an elongated, linearly extending slot 66 that slidably receives a protrusion 68 (e.g., a fastener or pin) extending from a respective one of the second links 54.

When the seatback frame 16 is in the upright position (FIGS. 1-4), the protrusions 68 are disposed at forward ends 70 of the slots 66. When the seatback frame 16 is in the fully reclined position (FIGS. 7 and 8), the protrusions 68 are disposed at aft ends 72 of the slots 66. The protrusions 68 slide along lengths of the slots 66 as the seatback frame 16 moves between the upright and fully reclined positions.

While not shown in the figures, the chaise seat bottom frame 14 and the seatback frame 16 may support cushions and may be covered with upholstery. In some configurations, support springs may be attached to the chaise seat bottom frame 14 and/or the seatback frame 16, and the support springs may support cushions.

The occupant 34 may manually drive the seatback frame 16 from the upright position to a partially reclined position or to the fully reclined position by applying a rearward force on the seatback frame 16 to cause the seatback frame 16 to rotate relative to the base frame 12 toward the fully reclined position. Such rotation of the seatback frame 16 toward the fully reclined position causes corresponding and simultaneous movement of the chaise seat bottom frame 14 toward the second position. That is, rotation of the seatback frame 16 from the upright position to the fully reclined position causes the protrusions 68 to slide along slots 66 and causes the support rod 40 to slide along slots 44 to move the chaise seat bottom frame 14 in a vertically upward and horizontally forward direction. The occupant 34 may apply a rearward force to the chaise seat bottom frame 14 to return the seatback frame 16 to the upright position and simultaneously return the chaise seat bottom frame 14 to the first position.

In some configurations, each of the protrusions 68 can include a tensioning system 69 (see FIGS. 4-7) that can be adjusted to provide a desired amount of resistance to the movement of the protrusions 68 along the slots 66. For example, as shown in the figures, the tensioning system 69 can include a threaded nut (e.g., a wing nut), a coil spring, and a washer. The nut, spring, and washer are received on the protrusion 68 such that the spring can adjustably compressed between the nut and washer to adjust the friction of the washer against the link 56. Increasing the friction against the link 56 increases resistance to the movement of the protrusion 68 along the slot 66, which in turn, resists movement of the seatback frame 16 between the upright and reclined positions and resists movement of the chaise seat bottom frame 14 between the first and second positions. Decreasing the friction against the link 56 decreases resistance to the movement of the protrusion 68 along the slot 66, which in turn, reduces resistance to movement of the seatback frame 16 between the upright and reclined positions and reduces resistance to movement of the chaise seat bottom frame 14 between the first and second positions.

In some configurations, tensioning systems similar or identical to the tensioning systems 69 can be included on the support rod 40 to adjust resistance of movement of the support rod 40 along slots 44.

In some configurations, the furniture member 10 may include one or more springs that bias the seatback frame 16 toward the upright position and bias the chaise seat bottom frame 14 toward the first position.

With reference to FIGS. 9-12, another furniture member 110 is provided. The furniture member 110 may be similar or identical to the furniture member 10 described above, except the furniture member 110 is powered by a motor-driven actuator 180.

Figure 11:
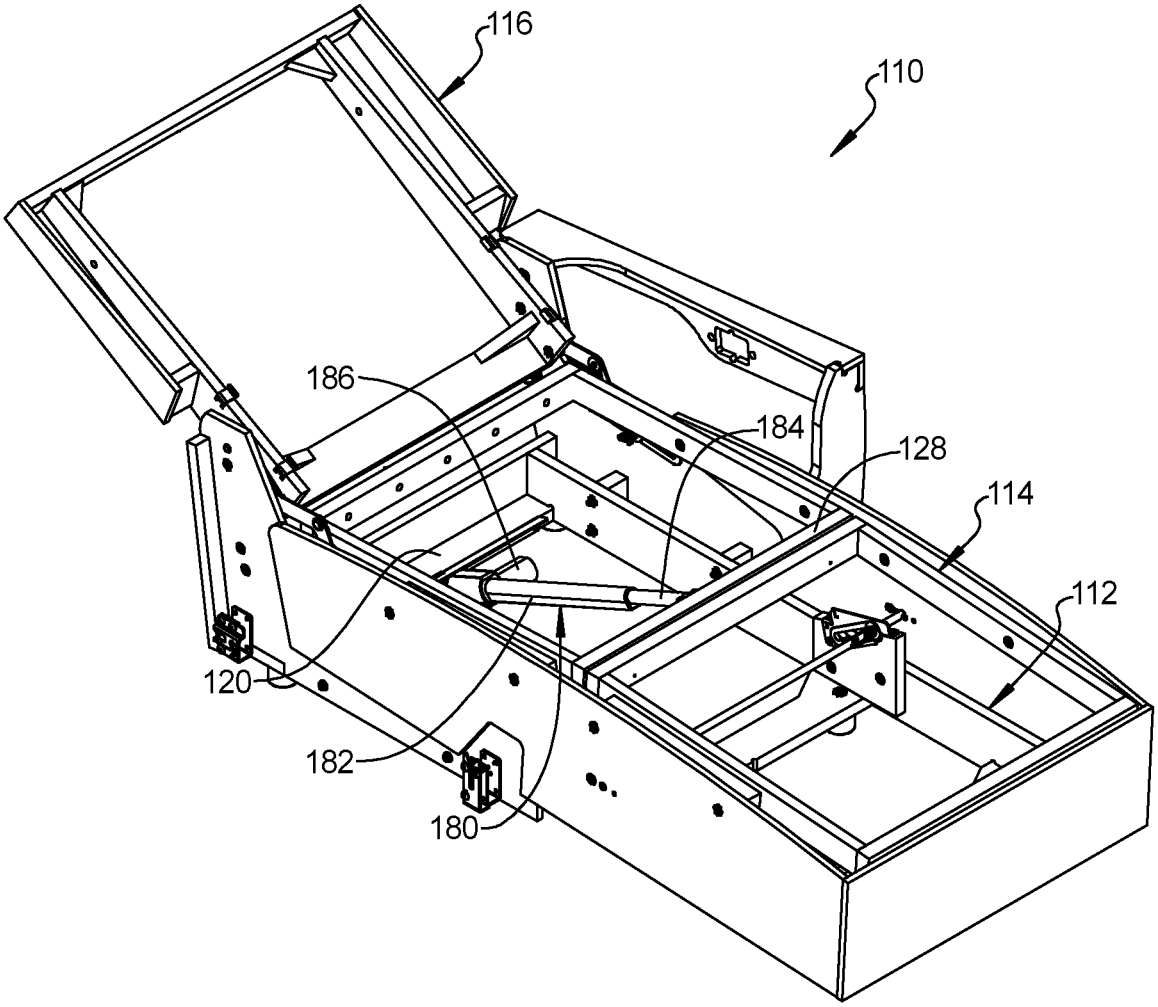
FIG. 11 is a perspective view of the furniture member of FIG. 9 with the seatback frame in a fully reclined position and the seat bottom frame in a second position.
Figure 12:
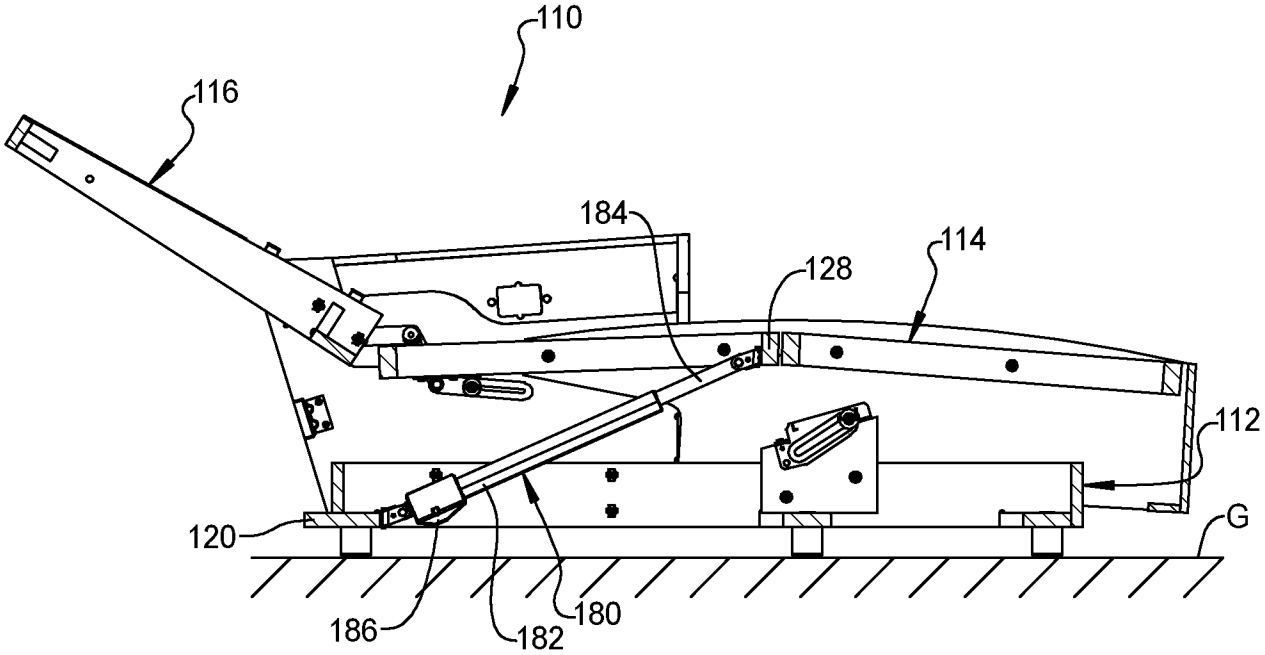
FIG. 12 is a cross-sectional view of the furniture member of FIG. 9 with the seatback frame in the fully reclined position and the seat bottom frame in the second position.

Like the furniture member 10, the furniture member 110 may include a base frame 112, a chaise seat bottom frame 114, and a seatback frame 116. The structure and function of the base frame 112, chaise seat bottom frame 114, and seatback frame 116 may be similar or identical to that of the base frame 12, chaise seat bottom frame 14, and seatback frame 16 described above. However, in the furniture member 110, the actuator 180 is operable to move the seatback frame 116 relative to the base frame 112 and the chaise seat bottom frame 114 between the upright position (FIGS. 9 and 10) and the fully reclined position (FIGS. 11 and 12) while simultaneously moving the chaise seat bottom frame 114 relative to the base frame 112 and the seatback frame 116 between the first position (FIGS. 9 and 10) and the second position (FIGS. 11 and 12).

The actuator 180 may be a linear actuator including a first arm 182, a second arm 184, and a motor 186. The second arm 184 may be partially received within the first arm 182 and may be movable relative to the first arm 182 in a telescoping manner. The motor 186 may be mounted to the first arm 182 and may drivingly engage the second arm 184 to move the second arm 184 relative to the first arm 182. An end of the first arm 182 may be rotatably attached to the base frame 112 (e.g., at a laterally extending support beam 120 of the base frame 112). A distal end of the second arm 184 may be rotatably attached to the chaise seat bottom frame 114 (e.g., at a laterally extending support beam 128 of the chaise seat bottom frame 114).

With reference to FIGS. 13-17, another furniture member 210 is provided. Like the furniture member 10, the furniture member 210 may include a base frame 212, a chaise seat bottom frame 214, and a seatback frame 216. The structure and function of the base frame 212, chaise seat bottom frame 214, and seatback frame 216 may be similar or identical to that of the base frame 12, chaise seat bottom frame 14, and seatback frame 16 described above, apart from certain exceptions described below. While the furniture member 210 depicted in FIGS. 13-17 is manually driven, in some configurations, the furniture member 210 could include a motor-driven actuator like the actuator 180, for example.

Like the base frame 12, the base frame 212 may include a plurality of fore-aft extending support beams 218 and a plurality of laterally extending support beams 220. Opposing fore-aft extending support beams 218 (i.e., fore-aft extending support beams 218 disposed on opposite lateral sides of the furniture member 210) may include one or more support members 240 that support the chaise seat bottom frame 214. For example, each of the opposing fore-aft extending support beams 218 may include a support member 240 (e.g. a pin, peg, protrusion, etc.) that extends laterally inward. Each support member 240 may be movably received in a slot 244 formed in a respective fore-aft extending support beam 226 of the chaise seat bottom frame 214. In other configurations, a single support member 240 (e.g., an elongated rod) may be attached to both of the opposing fore-aft extending support beams 218 and movably received in both of the slots 244 of the chaise seat bottom frame 214.

The slots 244 in the chaise seat bottom frame 214 may include an open end 245 and a closed end 247. The open end 245 may be provided for ease of assembly (e.g., the support members 240 may be received into the slots 244 through the open end 245. The closed end 247 may define a forward end of an inclined portion 249 of the slot 244. A horizontal surface 251 of the slot 244 may define an aft end of the inclined portion 249.

Figure 13:
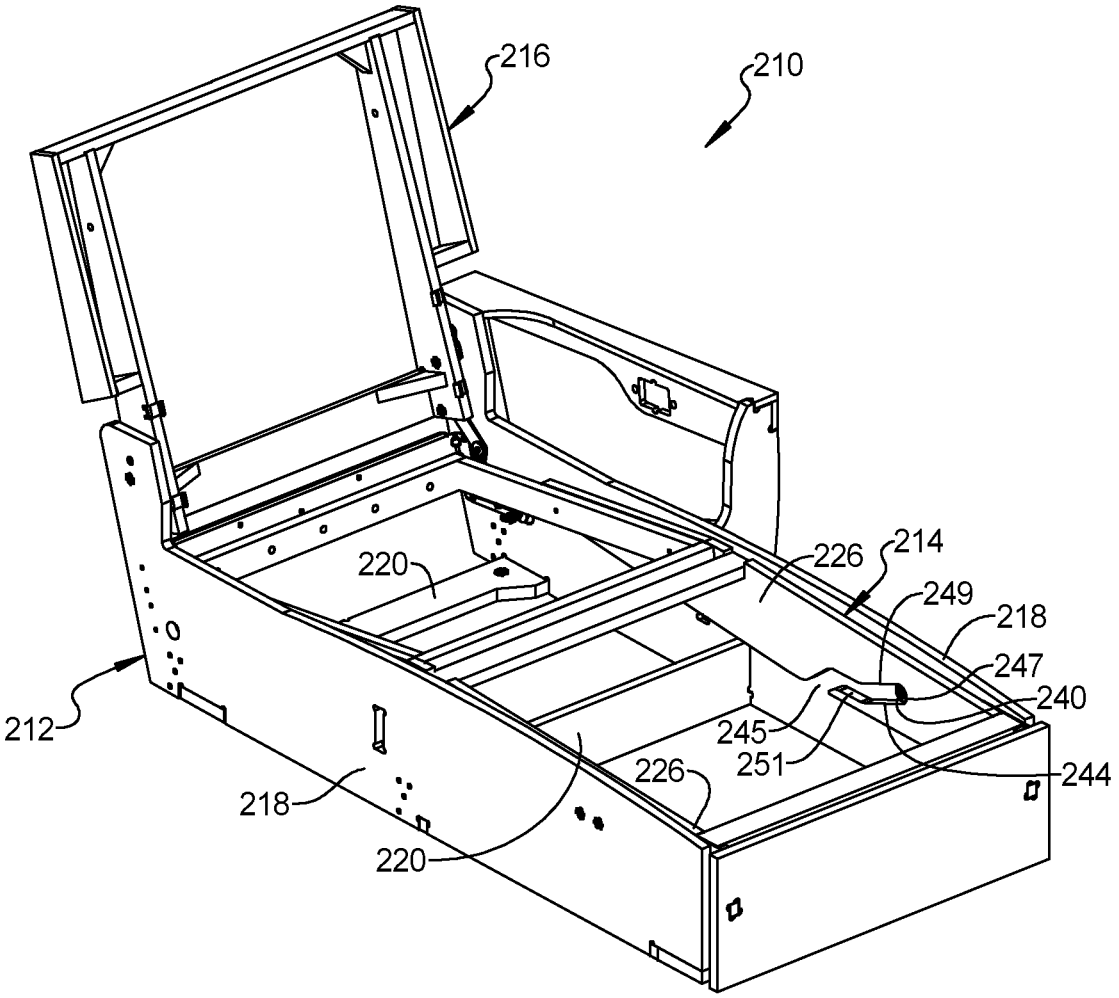
FIG. 13 is a perspective view of yet another furniture member with a seatback frame in an upright position and a seat bottom frame in a first position.
Figure 14:
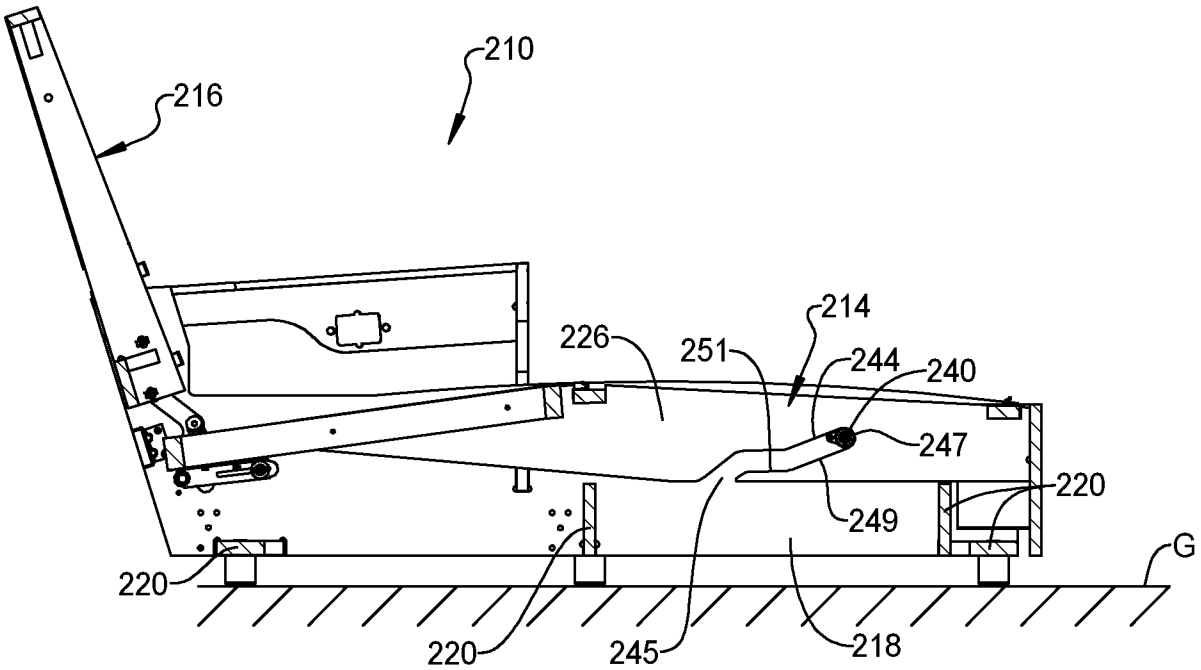
FIG. 14 is a cross-sectional view of the furniture member of FIG. 13 with the seatback frame in the upright position and the seat bottom frame in the first position.
Figure 15:
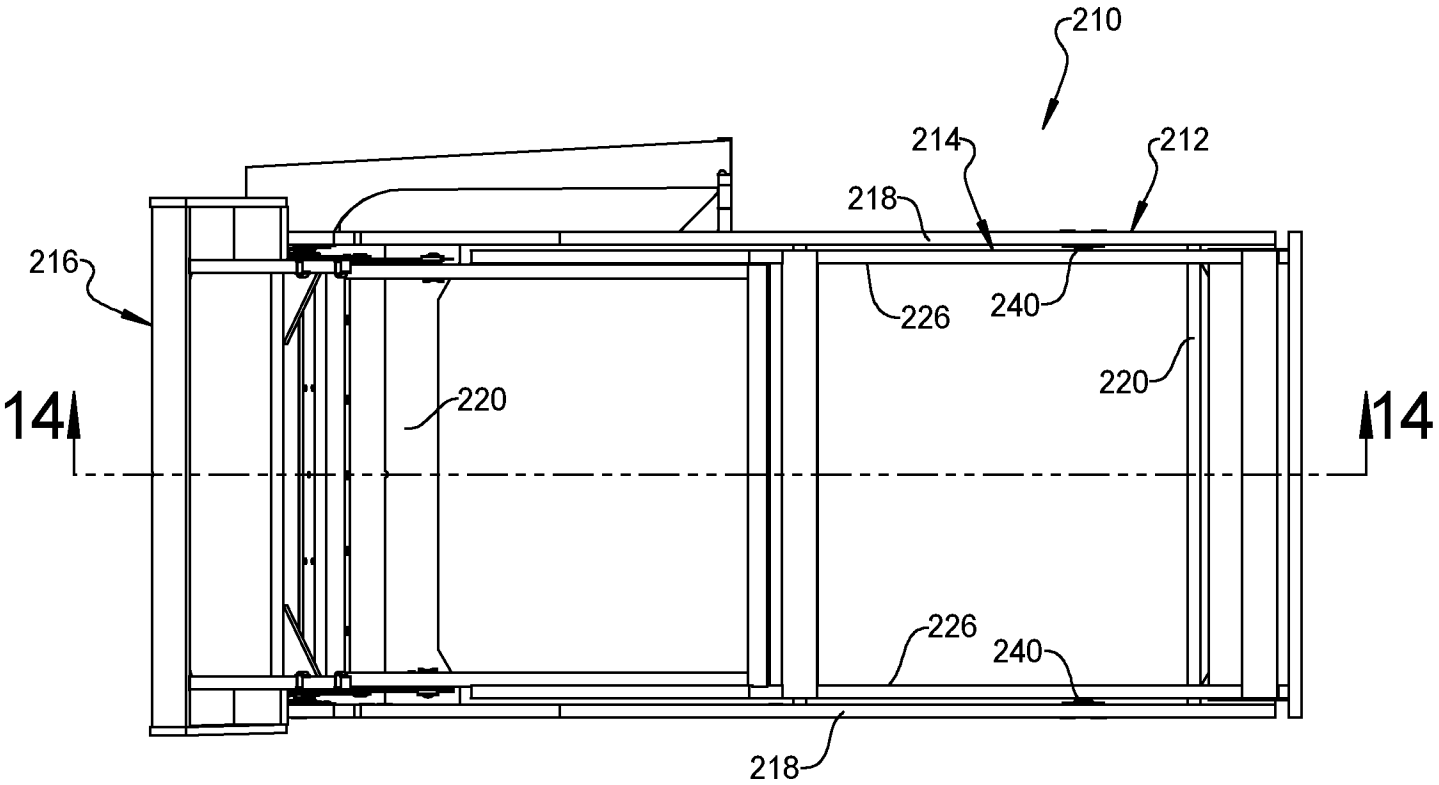
FIG. 15 is a plan view of the furniture member of FIG. 13 with the seatback frame in the upright position and the seat bottom frame in the first position.
Figure 16:
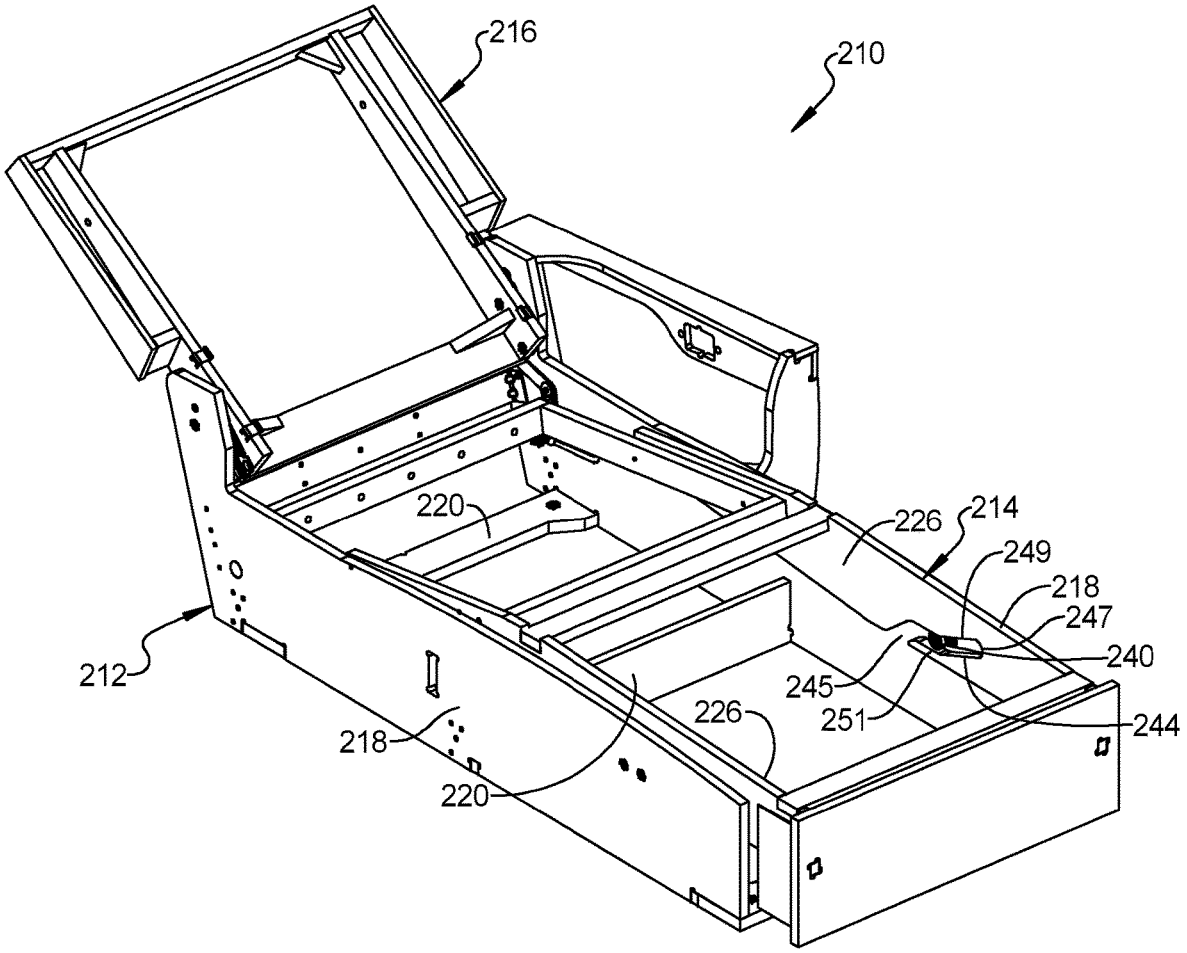
FIG. 16 is a perspective view of the furniture member of FIG. 13 with the seatback frame in a fully reclined position and the seat bottom frame in a second position.
Figure 17:
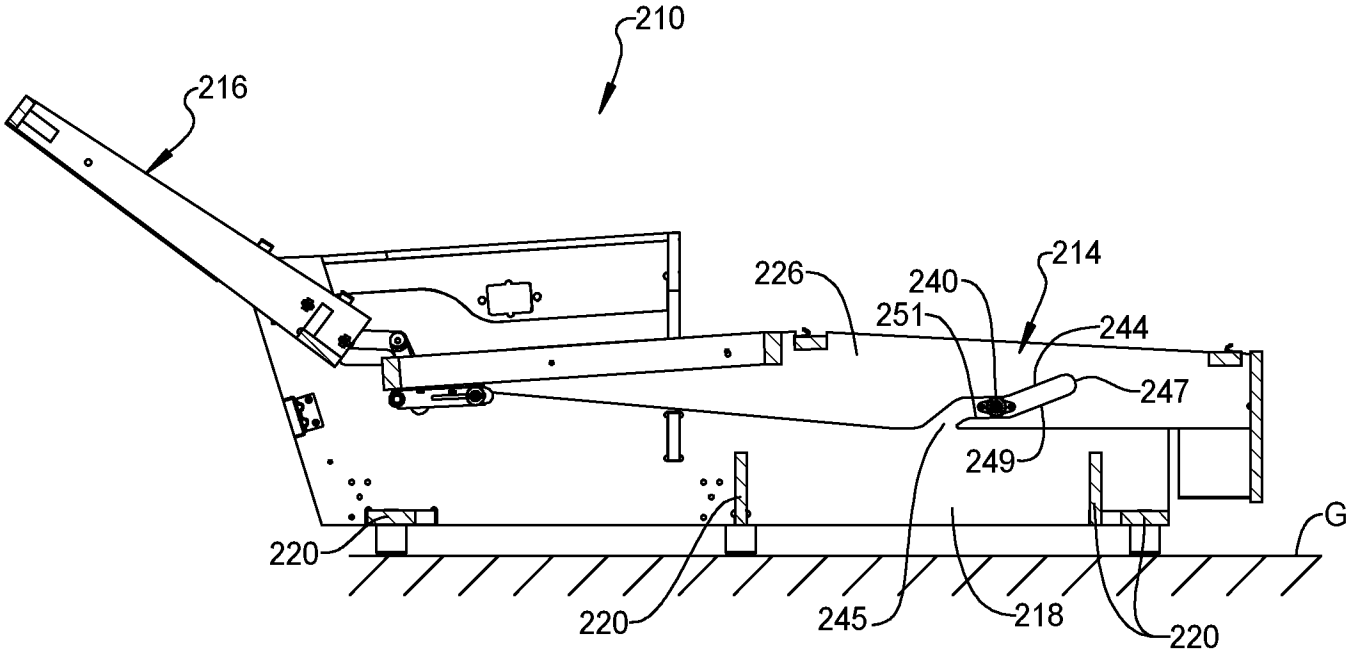
FIG. 17 is a cross-sectional view of the furniture member of FIG. 13 with the seatback frame in the fully reclined position and the seat bottom frame in the second position.
Figure 18:
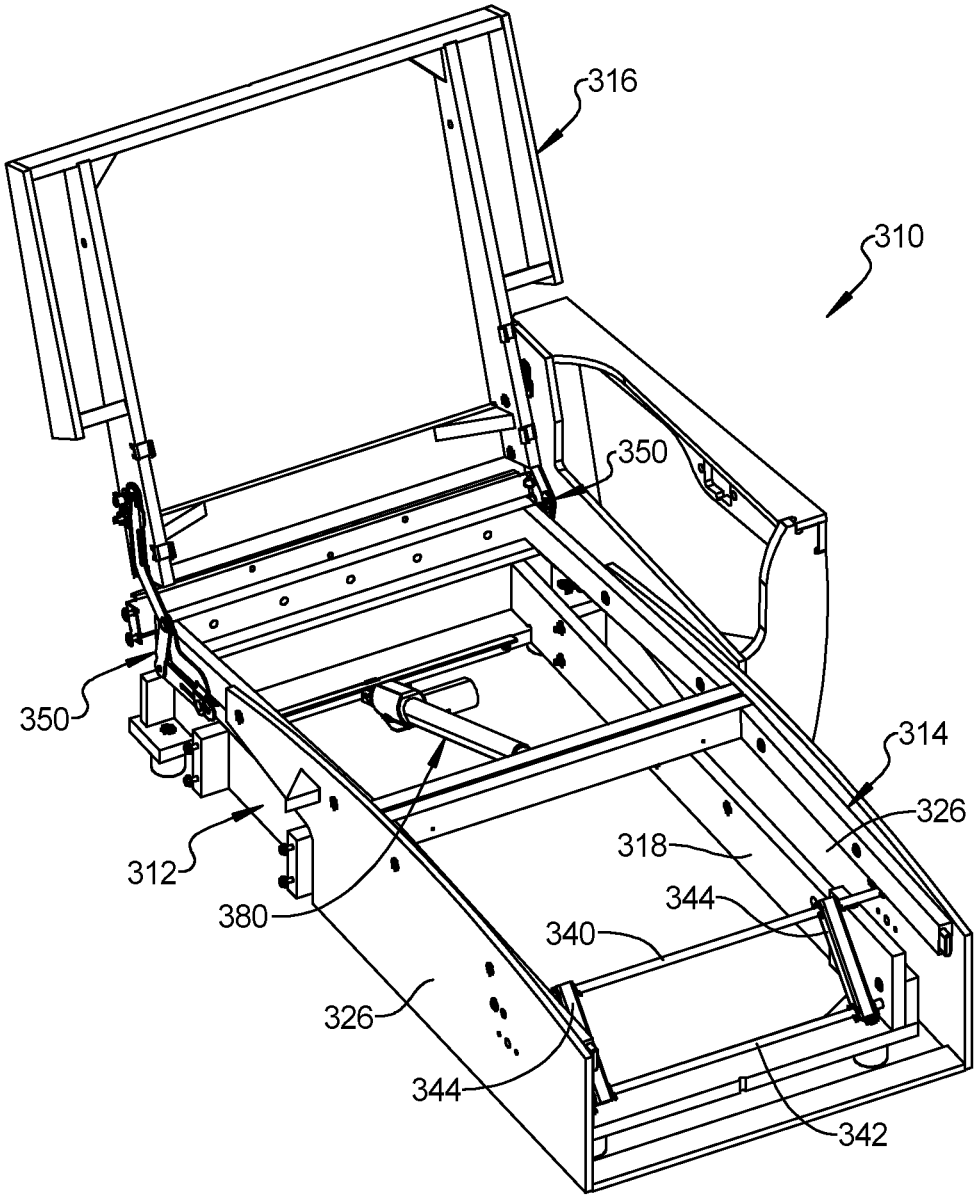
FIG. 18 is a perspective view of yet another furniture member with a seatback frame in an upright position and a seat bottom frame in a first position.
Figure 19:
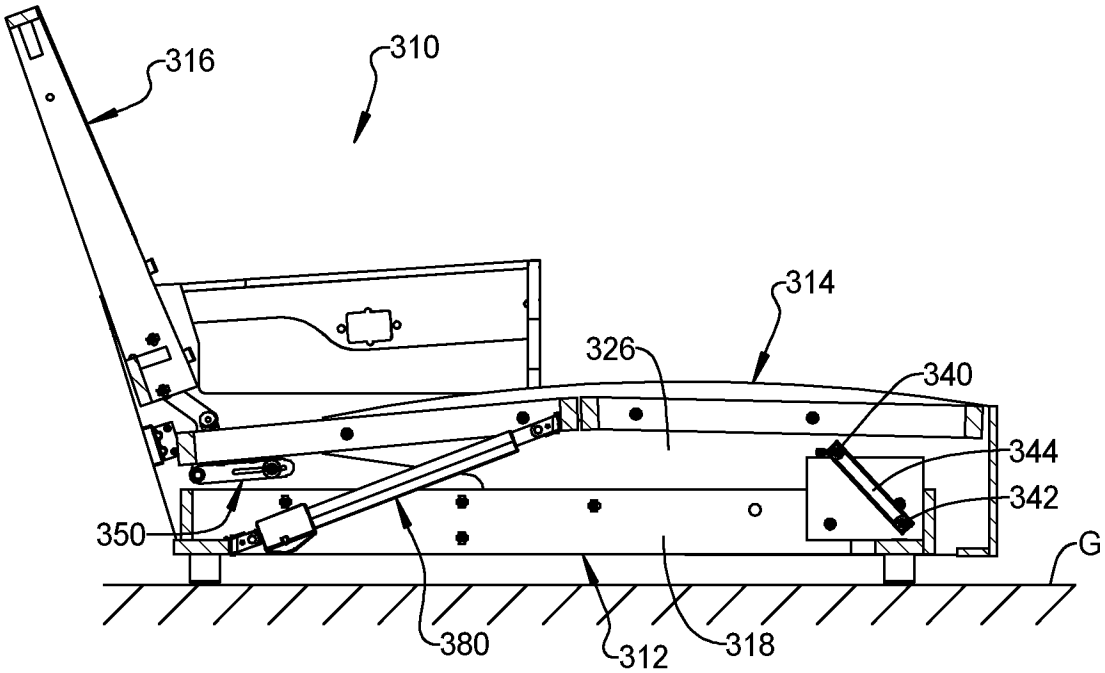
FIG. 19 is a cross-sectional view of the furniture member of FIG. 18 with the seatback frame in the upright position and the seat bottom frame in the first position.
Figure 20:
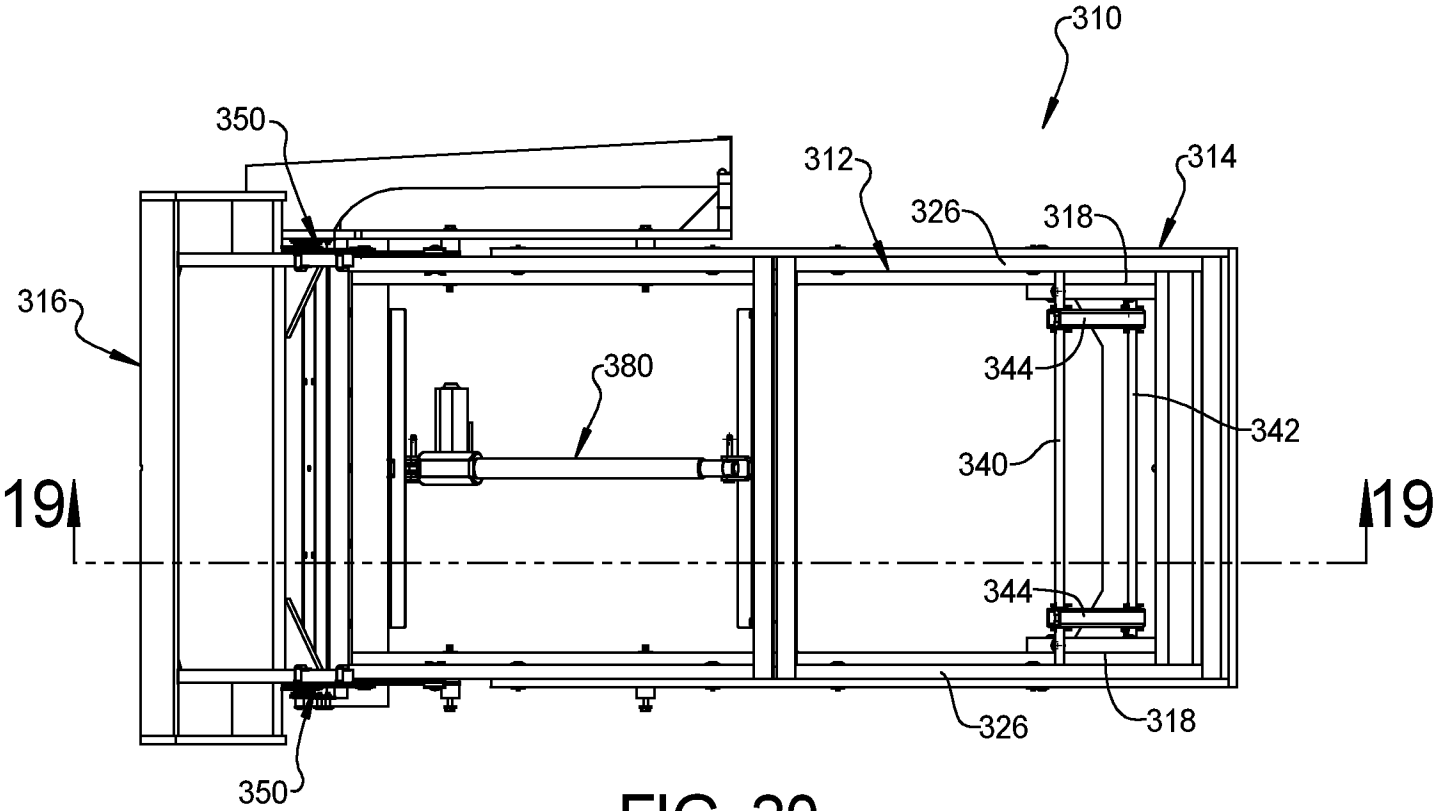
FIG. 20 is a plan view of the furniture member of FIG. 18 with the seatback frame in the upright position and the seat bottom frame in the first position.
Figure 21:
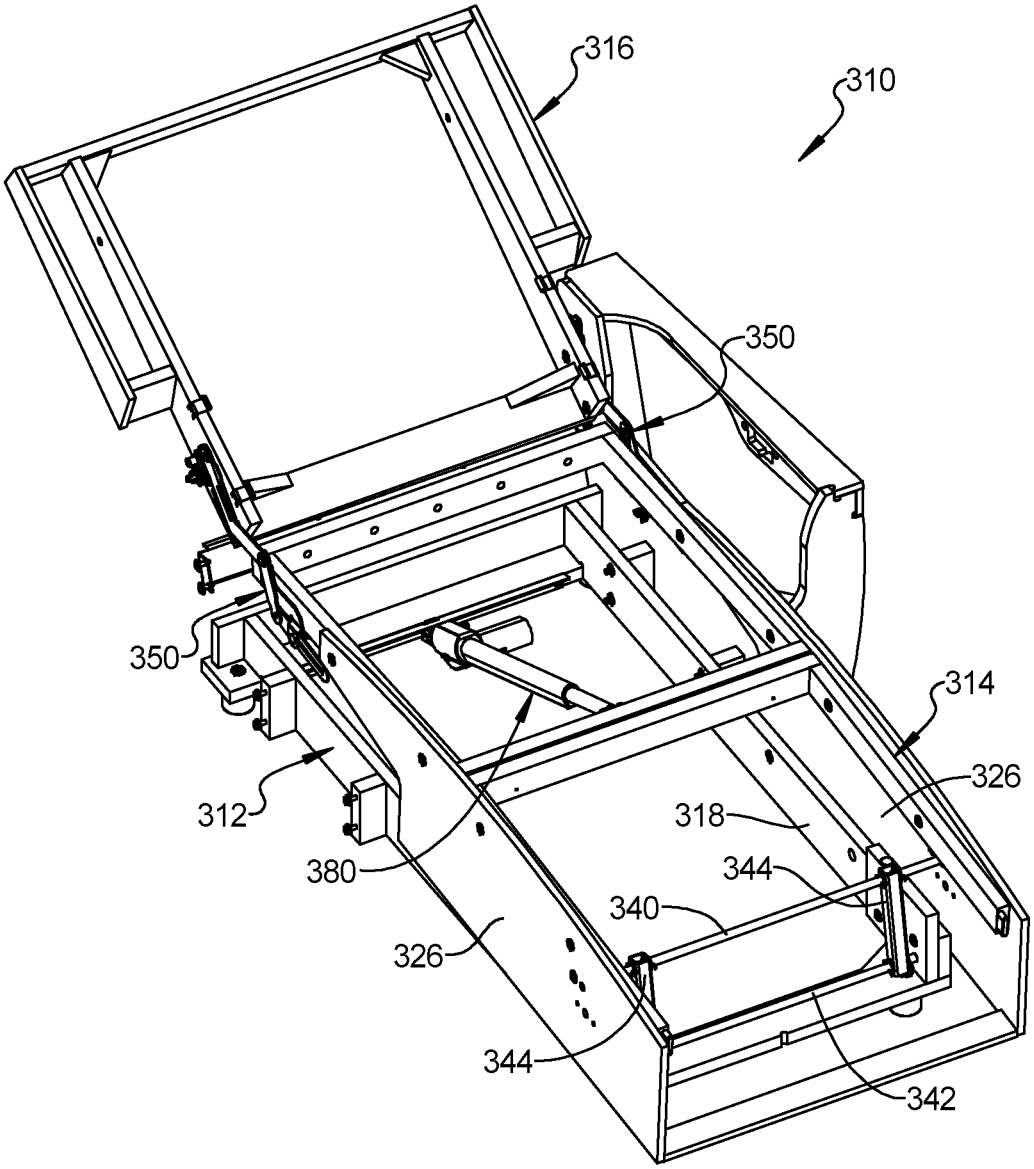
FIG. 21 is a perspective view of the furniture member of FIG. 18 with the seatback frame in a fully reclined position and the seat bottom frame in a second position.
Figure 22:
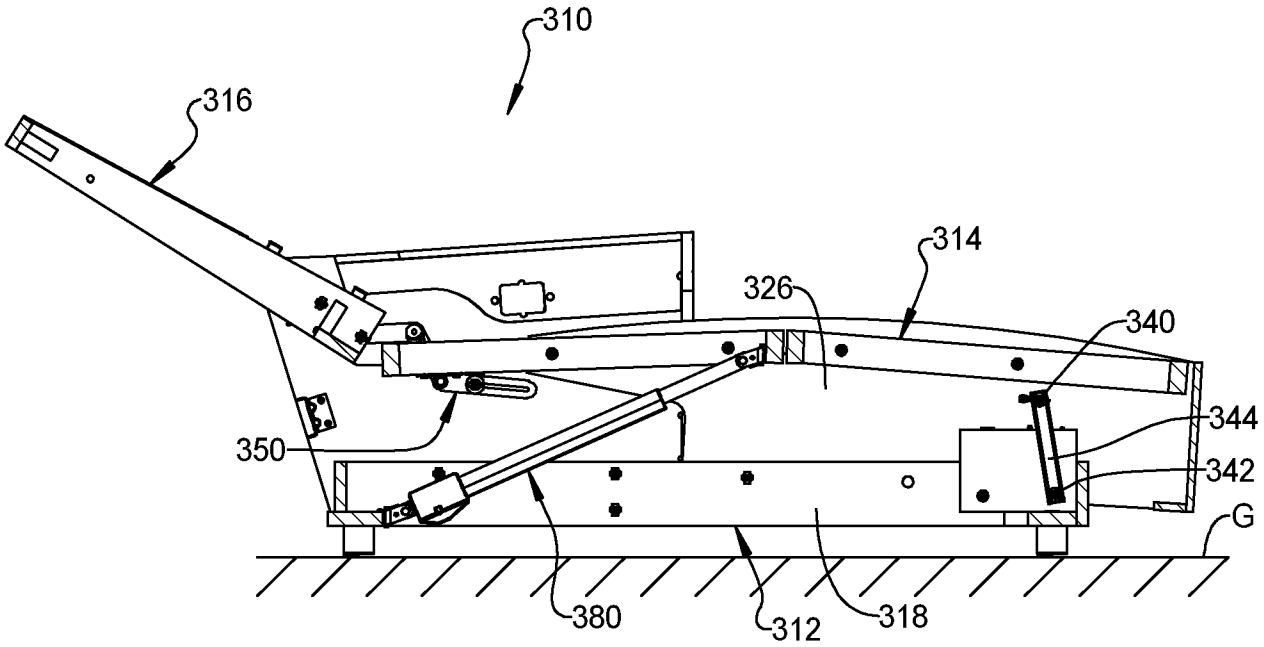
FIG. 22 is a cross-sectional view of the furniture member of FIG. 18 with the seatback frame in the fully reclined position and the seat bottom frame in the second position.
Figure 23:
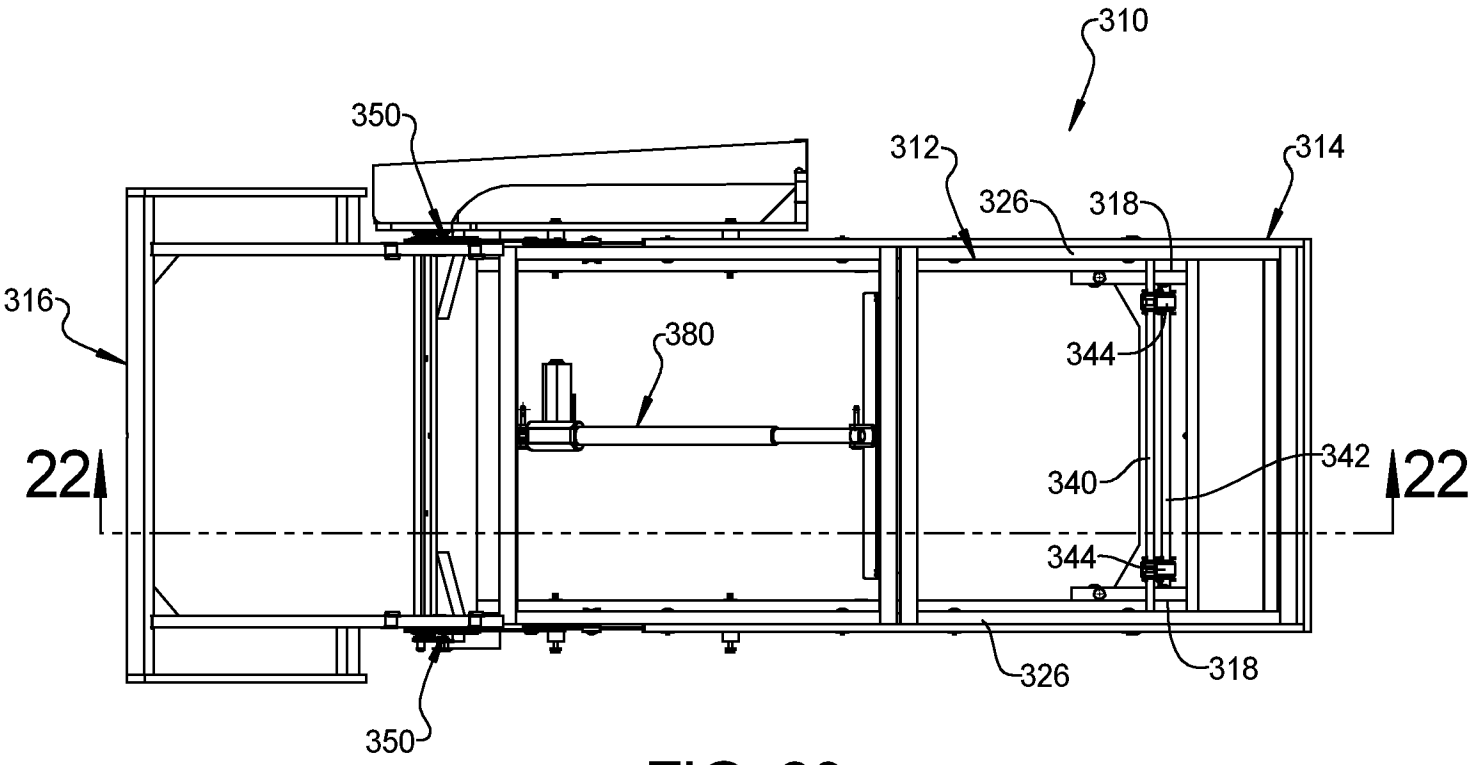
FIG. 23 is a plan view of the furniture member of FIG. 18 with the seatback frame in the fully reclined position and the seat bottom frame in the second position.
Figure 24:
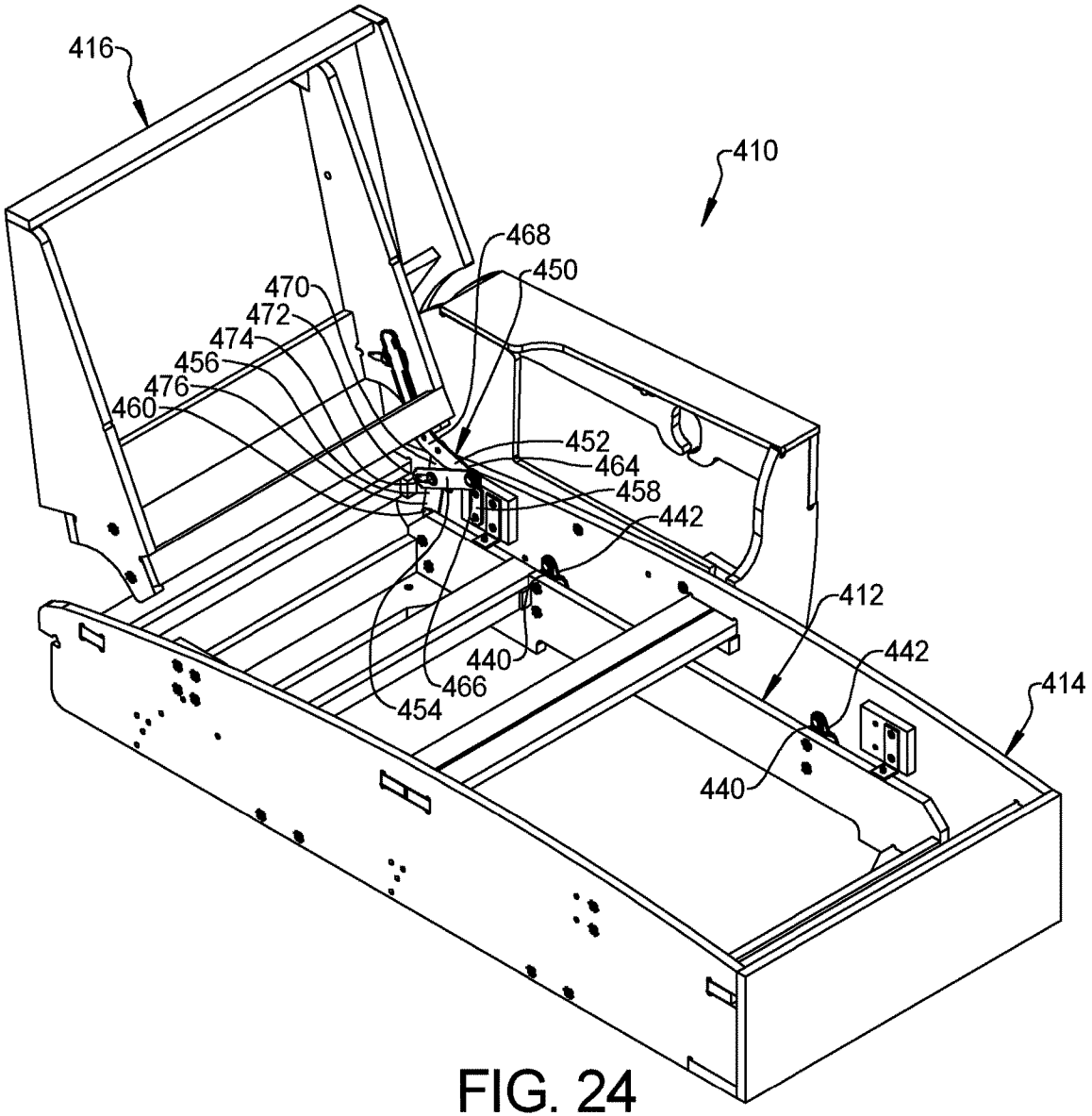
FIG. 24 is a perspective view of yet another furniture member with a seatback frame in an upright position and a seat bottom frame in a first position.

Like the furniture members 10, 110, the seatback frame 216 of the furniture member 210 is movable between the upright position (FIGS. 13-15) and the fully reclined position (FIGS. 16 and 17), and the chaise seat bottom frame 214 is simultaneously movable between the first position (FIGS. 13-15) and the second position (FIGS. 16 and 17). As described above, the chaise seat bottom frame 214 moves between the first and second positions as the seatback frame 216 moves between the upright and reclined positions. The support members 240 guide movement of the chaise seat bottom frame 214 between the first and second positions (i.e., one or more surfaces defining the inclined portions 249 of the slots 244 slide on the support member 240). As shown in FIGS. 13 and 14, the support members 240 are disposed at the forward ends of the inclined portions 249 of the slots 244 when the chaise seat bottom frame 214 is in the first position. As shown in FIGS. 16 and 17, the support members 240 are disposed at the aft ends of the inclined portions 249 of the slots 244 when the chaise seat bottom frame 214 is in the second position.

With reference to FIGS. 18-23, another furniture member 310 is provided. Like the furniture member 10, the furniture member 310 may include a base frame 312, a chaise seat bottom frame 314, and a seatback frame 316. The structure and function of the base frame 312, chaise seat bottom frame 314, and seatback frame 316 may be similar or identical to that of the base frame 12, chaise seat bottom frame 14, and seatback frame 16 described above, apart from certain exceptions described below. While the furniture member 310 depicted in FIGS. 18-23 is driven by a motor-driven actuator 380 (similar or identical to the actuator 180), in some configurations, the chaise seat bottom frame 314 and seatback frame 316 could be manually driven like the chaise seat bottom frame 14 and seatback frame 16.

The chaise seat bottom frame 314 may include a first support rod 340 attached to and extending laterally between two fore-aft extending support beams 326 of the chaise seat bottom frame 314 (i.e., two fore-aft extending support beams 326 that are disposed at opposite lateral sides of the chaise seat bottom frame 314). The base frame 312 may include a second support rod 342 (FIGS. 19, 20, 22, and 23) attached to and extending laterally between two fore-aft extending support beams 318 of the base frame 312 (i.e., two fore-aft extending support beams 318 that are disposed at opposite lateral sides of the base frame 312). Swing links 344 may be rotatably coupled to the first and second support rods 340, 342. That is, a first end of each swing link 344 may be rotatably coupled to the first support rod 340, and a second end of each swing link 344 may be rotatably coupled to the second support rod 342.

The seatback frame 316 may be coupled to the base frame 312 and chaise seat bottom frame 314 by a pair of linkages 350 (similar or identical to the linkages 50 described above) that allow the seatback frame 316 to move relative to the base frame 312 and the chaise seat bottom frame 314 between the upright position and the fully reclined position. When the seatback frame 316 moves between the upright and reclined positions, the swing links 344 will rotate about an axis defined by the second support rod 342 (i.e., a longitudinal axis of the second support rod 342) to move the chaise seat bottom frame 314 between the first and second positions. The base frame 312 may include stop members (e.g., plastic or rubber stoppers) that contact and support the swing links 344 when the chaise seat bottom frame 314 is in the first position.

With reference to FIGS. 24-27, another furniture member 410 is provided. Like the furniture member 10, the furniture member 410 may include a base frame 412, a chaise seat bottom frame 414, and a seatback frame 416. The structure and function of the base frame 412, chaise seat bottom frame 414, and seatback frame 416 may be similar or identical to that of the base frame 12, chaise seat bottom frame 14, and seatback frame 16 described above, apart from certain exceptions described below.

Figure 25:
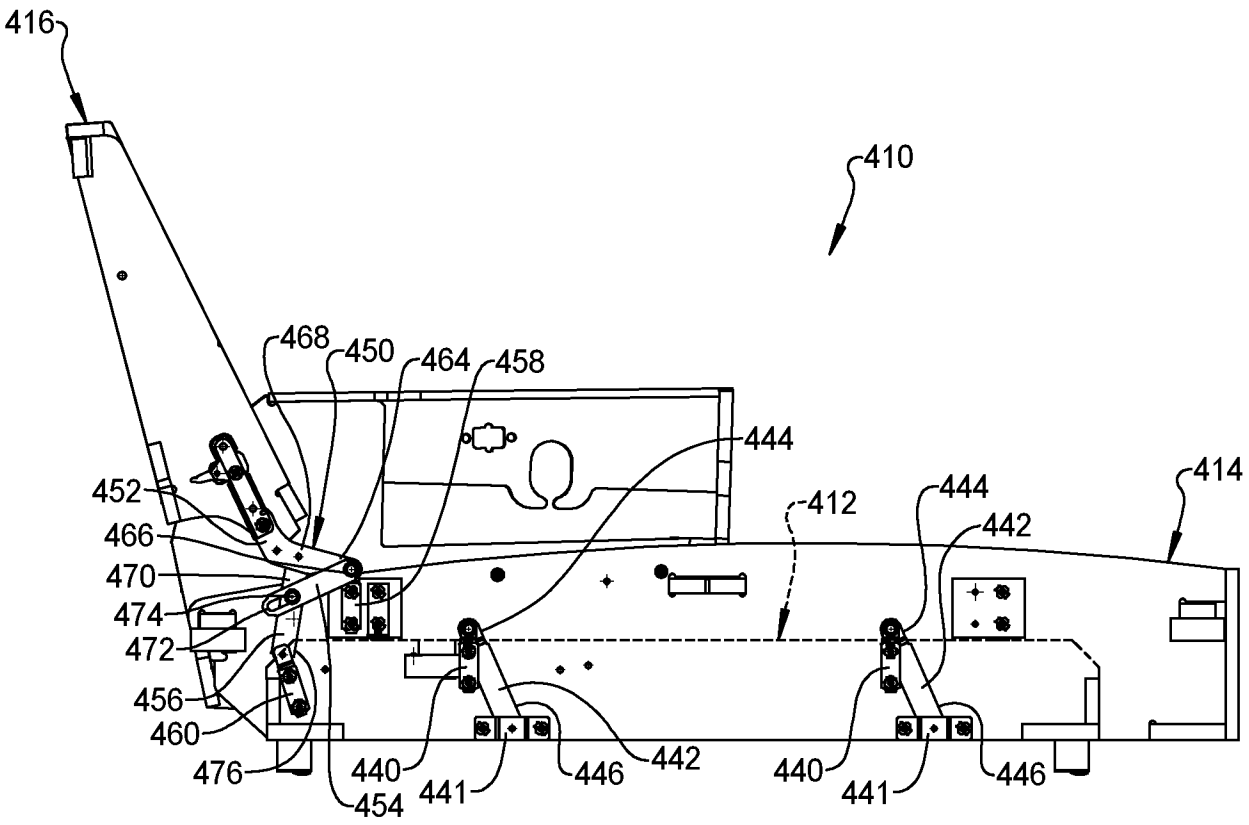
FIG. 25 is a partial side view of the furniture member of FIG. 24 with the seatback frame in the upright position and the seat bottom frame in the first position.
Figure 26:
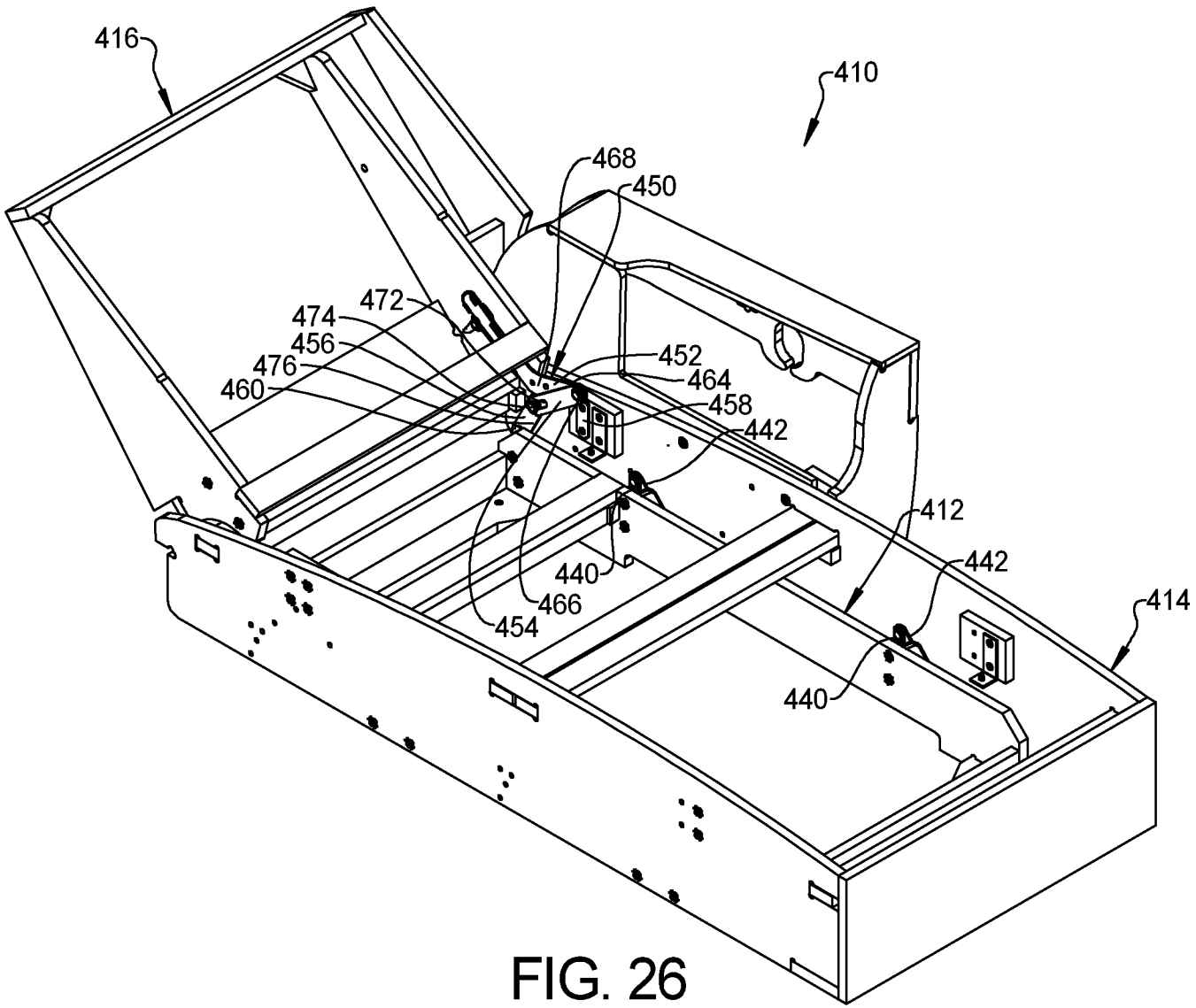
FIG. 26 is a perspective view of the furniture member of FIG. 24 with the seatback frame in a fully reclined position and the seat bottom frame in a second position.
Figure 27:
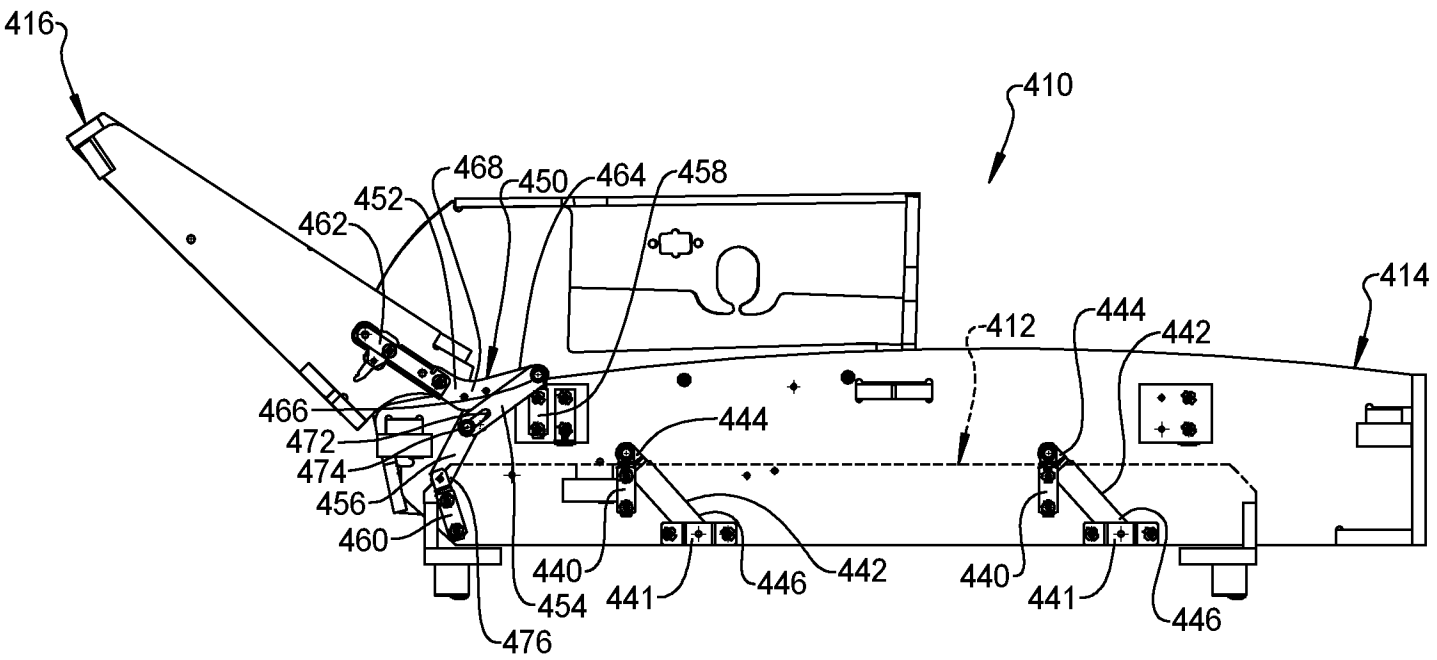
FIG. 27 is a partial side view of the furniture member of FIG. 24 with the seatback frame in the fully reclined position and the seat bottom frame in the second position.

As shown best in FIGS. 25 and 27, the chaise seat bottom frame 414 may be movable connected to the base frame 412 by a plurality of swing links 442. A first end 444 of each link 442 may be rotatably coupled to the base frame 412 (e.g., the first end 444 may be rotatably connected to a respective one of a plurality of brackets 440 fixedly mounted to the base frame 412). A second end 446 of the link 442 may be rotatably coupled to the chaise seat bottom frame 414 (e.g., the second end 446 may be rotatably connected to a respective one of a plurality of brackets 441 (FIGS. 25 and 27) fixedly mounted to the chaise seat bottom frame 414). In the particular example shown in the figures, the furniture member 410 includes four of the links 442 (e.g., two of the links 442 are attached to each lateral side of the chaise seat bottom frame 414). However, other configurations of the furniture member 410 may have different numbers of links 442. The links 442 support the chaise seat bottom frame 414 relative to the base frame 412 and allow the chaise seat bottom frame 414 to move relative to the base frame 412 between a first position (FIGS. 24 and 25) and a second position (FIGS. 26 and 27). As described above with respect to the furniture member 10, the second position of the chaise seat bottom frame 414 is vertically upward and horizontally forward relative to the first position.

The seatback frame 416 may be coupled to the base frame 412 and chaise seat bottom frame 414 by a pair of linkages 450 (one linkage 450 on each lateral side of the seatback frame 416) that allow the seatback frame 416 to move relative to the base frame 412 and the chaise seat bottom frame 414 between an upright position and a fully reclined position. When the seatback frame 416 moves between the upright and reclined positions, the links 442 will rotate relative to the base frame 412 to move the chaise seat bottom frame 414 relative to the base frame 412 between the first and second positions.

Each of the linkages 450 may include a first link 452, a second link 454, and a third link 456. A first end 462 of the first link 452 may be fixedly attached to the seatback frame 416. A second end 464 of the first link 452 may be rotatably connected to the chaise seat bottom frame 414 (e.g., the second end 464 may be rotatably connected to a bracket 458 that is fixedly mounted to the chaise seat bottom frame 414). The second end 464 of the first link 452 may also be rotatably connected to a first end 466 of the second link 454. An intermediate portion 468 of the first link 452 may be rotatably connected to a first end 470 (FIGS. 24 and 25) of the third link 456.

The second link 454 may include an elongated, linearly extending slot 472 that slidably receives a protrusion 474 (e.g., a fastener or pin) extending from the third link 456. A second end 476 of the third link 456 may be rotatably connected to the base frame 412 (e.g., the second end 476 may be rotatably connected to a bracket 460 that is fixedly mounted to the base frame 412).

When the seatback frame 416 is in the upright position (FIGS. 24 and 25), the protrusion 474 is disposed at a forward end of the slot 472 of the second link 454. When the seatback frame 416 is in the fully reclined position (FIGS. 26 and 27), the protrusion 474 is disposed at an aft end of the slot 472 of the second link 454. The protrusion 474 slides along length of the slots 472 as the seatback frame 416 moves between the upright and fully reclined positions.

In some configurations, the protrusions 474 can include tensioning systems similar or identical to the tensioning systems 69 described above.

While not shown in the figures, the chaise seat bottom frame 414 and the seatback frame 416 may support cushions and may be covered with upholstery. In some configurations, support springs may be attached to the chaise seat bottom frame 414 and/or the seatback frame 416, and the support springs may support cushions.

An occupant seated in the furniture member 410 (e.g., like the occupant 34 is seated in the furniture member 10 as shown in FIG. 2) may manually drive the seatback frame 416 from the upright position to a partially reclined position or to the fully reclined position by applying a rearward force on the seatback frame 416 to cause the seatback frame 416 to rotate relative to the base frame 412 toward the fully reclined position. Such rotation of the seatback frame 416 toward the fully reclined position causes corresponding and simultaneous movement of the chaise seat bottom frame 414 toward the second position. That is, rotation of the seatback frame 416 from the upright position to the fully reclined position causes the protrusions 474 of linkages 450 to slide along slots 472 and causes rotation of the links 442 to move the chaise seat bottom frame 414 in a vertically upward and horizontally forward direction. The occupant may apply a rearward force to the chaise seat bottom frame 414 to return the seatback frame 416 to the upright position and simultaneously return the chaise seat bottom frame 414 to the first position.

The linkages 450 and the links 442 are configured so that the occupant's body weight balances (or resists) movement of the seatback frame 416 from the upright position to the reclined position. That is, because the weight of the chaise seat bottom frame 414 and the weight of the occupant are suspended from the base frame 412 on the links 442 and because of the linkages 450 coupling the seatback frame 416 to the chaise seat bottom frame 414 and the base frame 412, movement of the seatback frame 416 toward the recline position causes upward vertical movement of the chaise seat bottom frame 414 (as described above). Such vertical movement of the weight of the chaise seat bottom frame 414 and the occupant provides a resisting force to balance the recline force of the seatback frame 416.

Furthermore, because the linkages 450 couple the seatback frame 416 to the chaise seat bottom frame 414, the horizontally forward movement of the chaise seat bottom frame 414 while the seatback 16 is moving toward the recline position also results in forward movement of the seatback frame 416 while the seatback frame 416 is reclining. This allows the furniture member 410 to be positioned closer to a wall (e.g., a wall in the occupant's home) and still have enough wall clearance to move the seatback frame 416 into the fully reclined position.

With reference to FIGS. 28-31, another furniture member 510 is provided that may be similar or identical to the furniture member 410 described above, except the furniture member 510 includes a motor-driven actuator 580 that drives movement of the furniture member 510. Like the furniture member 410, the furniture member 510 may include a base frame 512, a chaise seat bottom frame 514, a seatback frame 516, swing links 542, and linkages 550.

The structure and function of the base frame 512, chaise seat bottom frame 514, seatback frame 516, links 542, and linkages 550 may be similar or identical to that of the base frame 412, chaise seat bottom frame 414, seatback frame 416, links 442, and linkages 450 described above. However, in the furniture member 510, the actuator 580 is operable to move the seatback frame 516 relative to the base frame 512 and the chaise seat bottom frame 514 between the upright position (FIGS. 28 and 29) and the fully reclined position (FIGS. 30 and 31) while simultaneously moving the chaise seat bottom frame 514 relative to the base frame 512 between the first position (FIGS. 28 and 29) and the second position (FIGS. 30 and 31).

Figure 28:
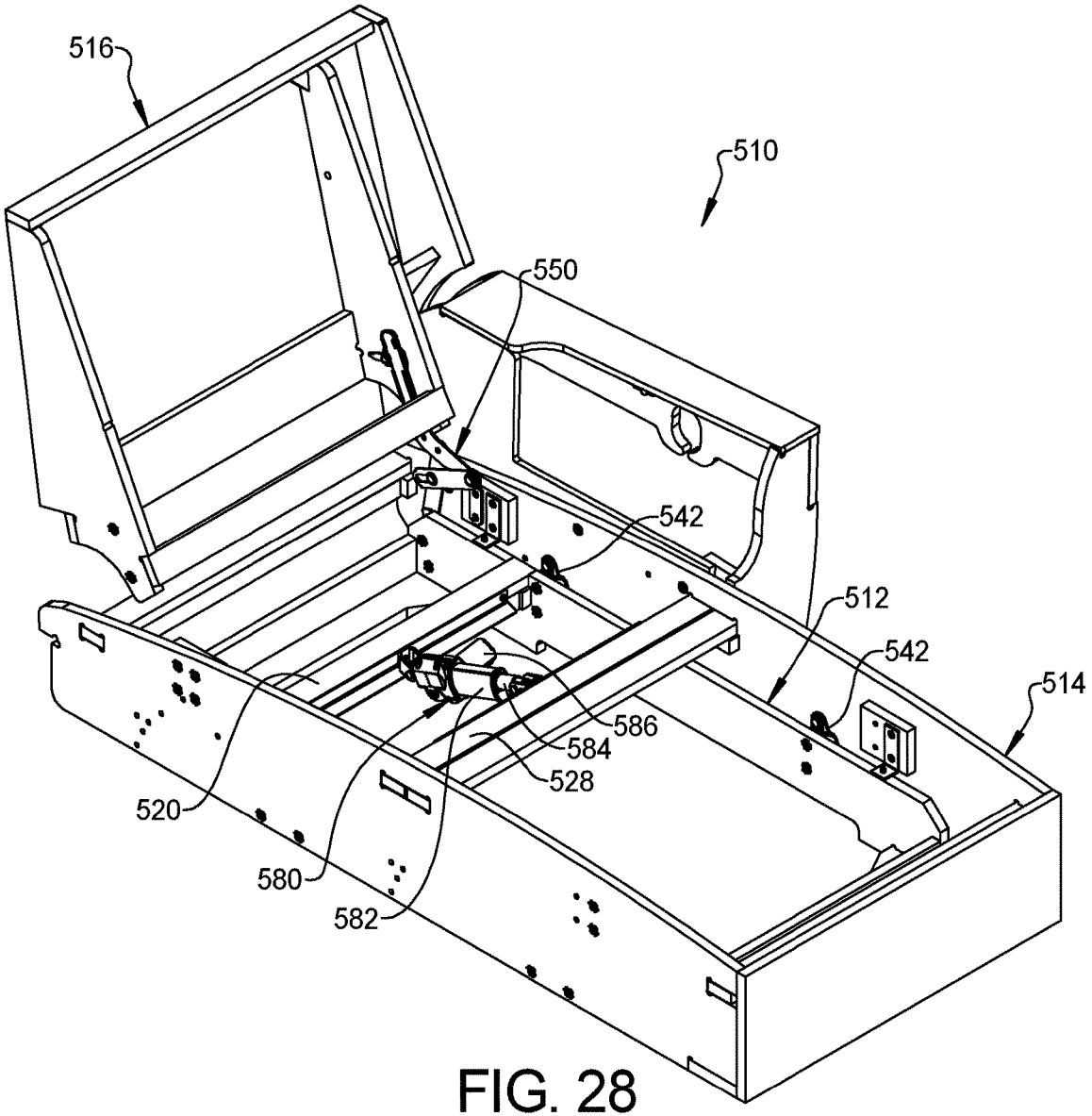
FIG. 28 is a perspective view of yet another furniture member with a seatback frame in an upright position and a seat bottom frame in a first position.
Figure 29:
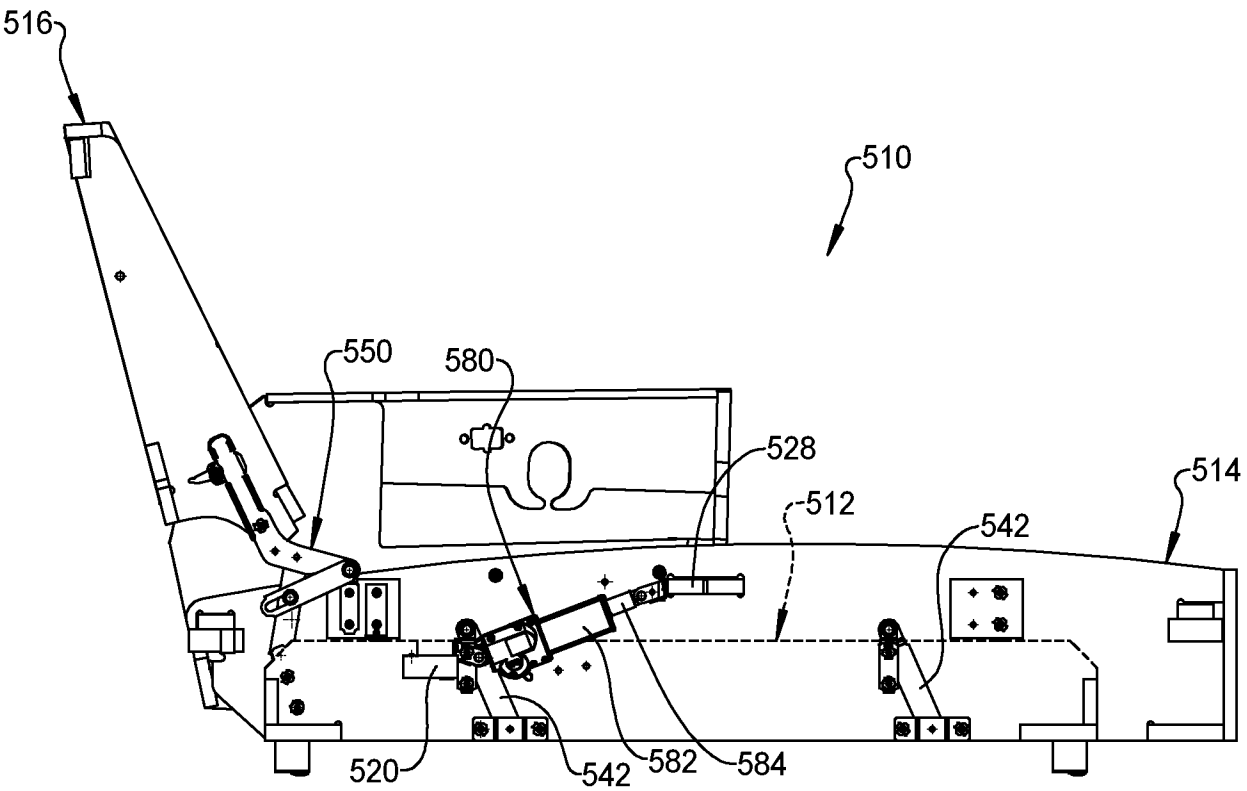
FIG. 29 is a partial side view of the furniture member of FIG. 28 with the seatback frame in the upright position and the seat bottom frame in the first position.
Figure 30:
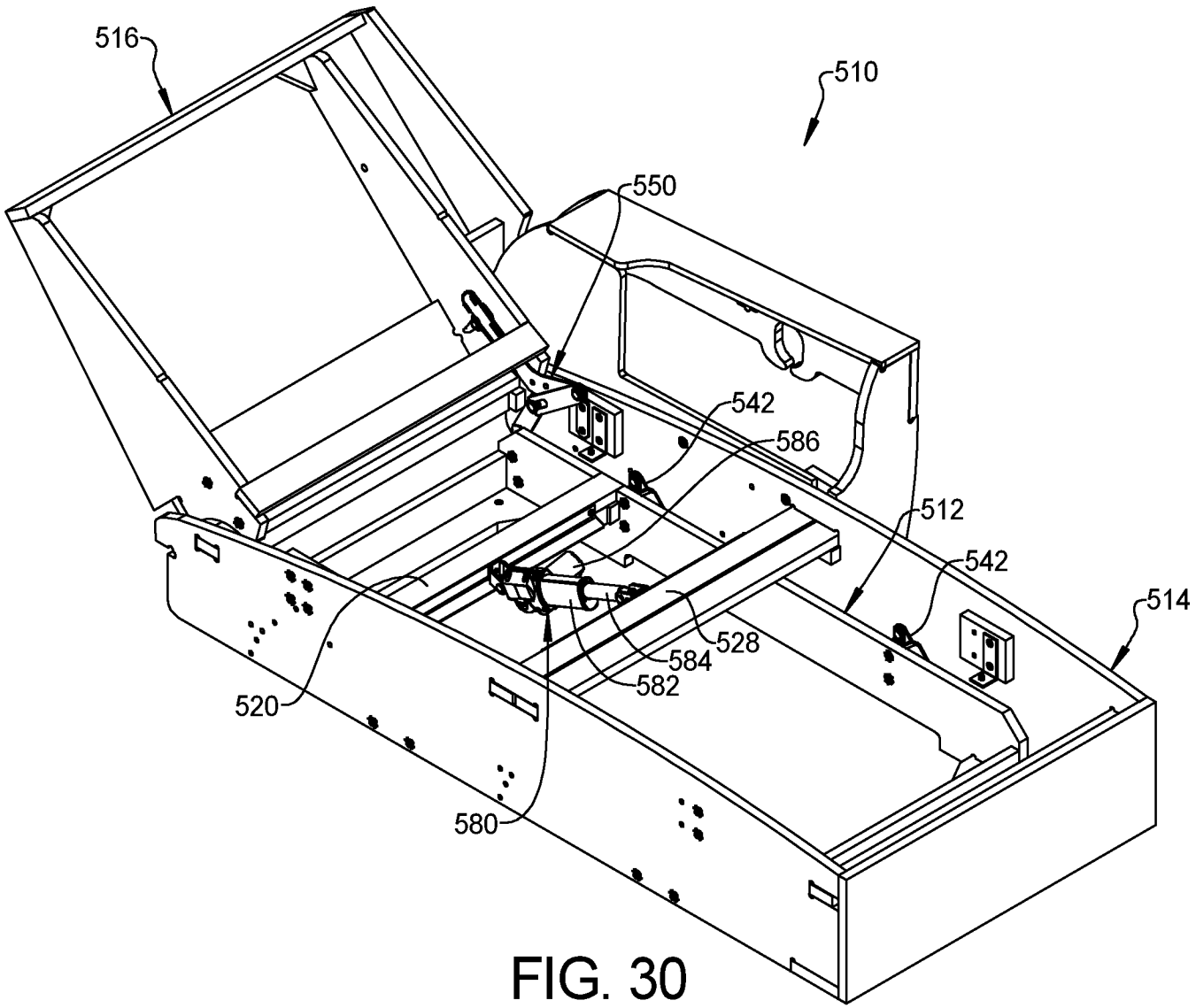
FIG. 30 is a perspective view of the furniture member of FIG. 28 with the seatback frame in a fully reclined position and the seat bottom frame in a second position.
Figure 31:
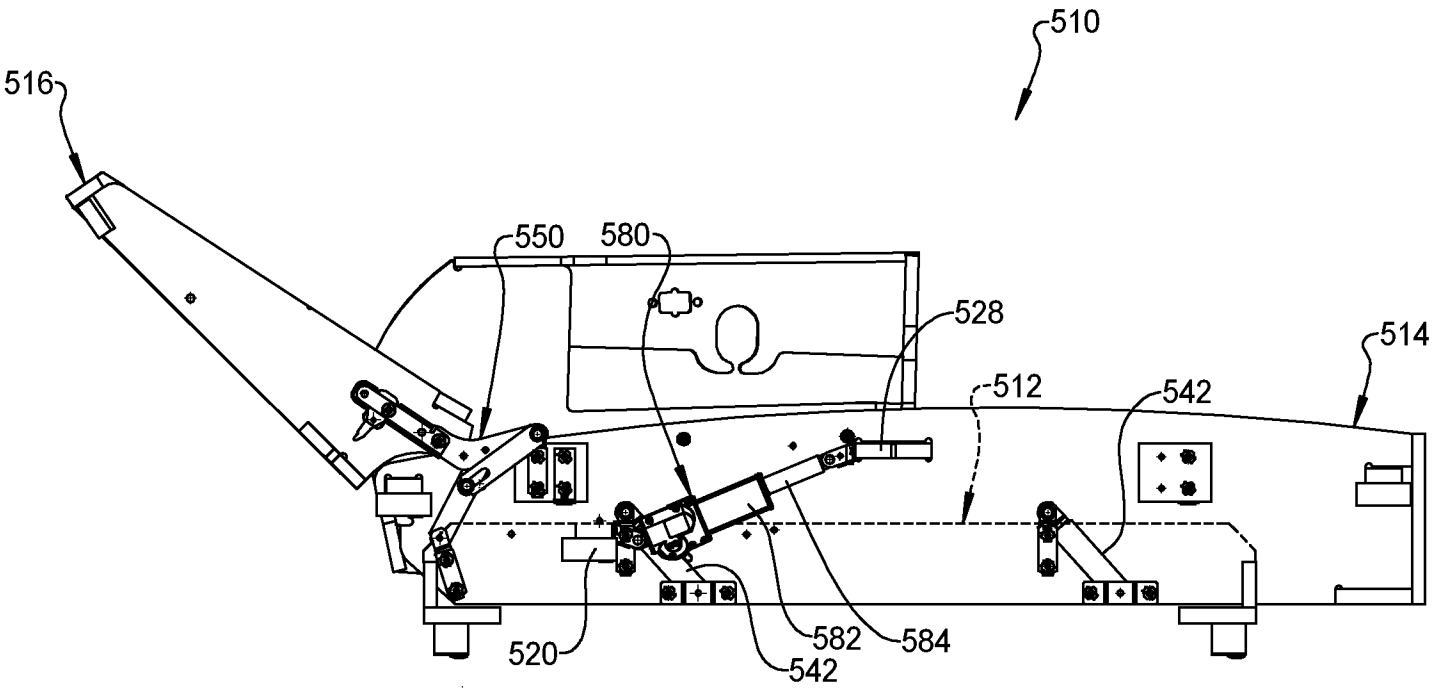
FIG. 31 is a partial side view of the furniture member of FIG. 28 with the seatback frame in the fully reclined position and the seat bottom frame in the second position.

The actuator 580 may be a linear actuator including a first arm 582, a second arm 584, and a motor 586 (FIGS. 28 and 30). The second arm 584 may be partially received within the first arm 582 and may be movable relative to the first arm 582 in a telescoping manner. The motor 586 may be mounted to the first arm 582 and may drivingly engage the second arm 584 to move the second arm 584 relative to the first arm 582. An end of the first arm 582 may be rotatably attached to the base frame 512 (e.g., at a laterally extending support beam 520 of the base frame 512). A distal end of the second arm 584 may be rotatably attached to the chaise seat bottom frame 514 (e.g., at a laterally extending support beam 528 of the chaise seat bottom frame 514).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member comprising:

a base frame;

a chaise seat bottom frame supported by the base frame and movable relative to the base frame between a first position and a second position, wherein the chaise seat bottom frame includes an upper-leg-supporting portion and a lower-leg-supporting portion that are fixedly attached to each other, wherein the lower-leg-supporting portion supports an occupant's lower legs in an extended position relative to the occupant's upper legs; and a seatback frame supported by the base frame and movable relative to the base frame and the chaise seat bottom frame between an upright position and a reclined position, wherein movement of the seatback frame from the upright position to the reclined position causes corresponding and simultaneous movement of the chaise seat bottom frame vertically upward and horizontally forward relative to an aft end of the base frame from the first position to the second position, wherein the seatback frame is coupled to the base frame by a first link of a linkage, wherein the upper-leg-supporting portion of the chaise seat bottom frame is coupled to the seatback frame by a second link of the linkage, wherein the second link is fixed relative to the chaise seat bottom frame, wherein the second link is rotatably coupled to the first link, wherein the linkage includes a third link that is rotatably coupled to the first link, and wherein the third link includes a slot that slidably receives a portion of the second link.

2. The furniture member of claim 1, wherein the base frame includes an armrest, and wherein at least a majority of the lower-leg-supporting portion of the chaise seat bottom frame is disposed in front of a front end of the armrest when the chaise seat bottom frame is in the first position and when the chaise seat bottom frame is in the second position.

3. The furniture member of claim 1, further comprising a motor-driven actuator having a first end attached to the base frame and a second end attached to the chaise seat bottom frame, wherein actuation of the motor-driven actuator moves the seatback frame between the upright and reclined positions and moves the chaise seat bottom frame between the first and second positions.

4. The furniture member of claim 1, wherein the chaise seat bottom frame is coupled to the base frame by a plurality of swing links that rotates relative to the base frame and the chaise seat bottom frame as the chaise seat bottom frame moves between the first and second positions.

5. The furniture member of claim 4, wherein the chaise seat bottom frame is suspended from the base frame on the plurality of swing links such that vertical movement of the weight of the chaise seat bottom frame and the occupant provides a resisting force to balance a recline force of the seatback frame.

6. The furniture member of claim 5, wherein the horizontally forward movement of the chaise seat bottom frame while the seatback is moving toward the recline position also results in forward movement of a bottom end of the seatback while the seatback is moving toward the reclined position.

7. The furniture member of claim 1, wherein the seatback frame is able to be positioned at an infinite number of positions between the upright and reclined positions, and wherein the chaise seat bottom frame is able to be positioned at an infinite number of positions between the first and second positions.

8. A furniture member comprising:

a base frame;

a chaise seat bottom frame supported by the base frame and movable relative to the base frame between a first position and a second position, wherein the chaise seat bottom frame includes an upper-leg-supporting portion and a lower-leg-supporting portion that are fixedly attached to each other, wherein the lower-leg-supporting portion supports an occupant's lower legs in an extended position relative to the occupant's upper legs; and a seatback frame supported by the base frame and movable relative to the base frame and the chaise seat bottom frame between an upright position and a reclined position, wherein movement of the seatback frame from the upright position to the reclined position causes corresponding and simultaneous movement of the chaise seat bottom frame vertically upward and horizontally forward relative to an aft end of the base frame from the first position to the second position, wherein the chaise seat bottom frame includes a support rod, and wherein the base frame includes a bracket having an elongated slot that movably receives the support rod, and wherein the support rod moves along a length of the slot as the chaise seat bottom frame moves between the first and second positions.

9. The furniture member of claim 8, wherein:

the seatback frame is coupled to the base frame and the chaise seat bottom frame by a linkage that allows movement of the seatback frame between the upright and reclined positions, the linkage includes a first link, a second link, and a third link, the first link is fixedly attached to the seatback frame and rotatably attached to the chaise seat bottom frame, the second link is rotatably attached to the chaise seat bottom frame and includes a slot, the third link is rotatably attached to the base frame and rotatably attached to the first link, and the third link includes a protrusion that is slidably received in the slot of the second link.

10. A furniture member comprising:

a base frame;

a chaise seat bottom frame supported by the base frame and movable relative to the base frame between a first position and a second position, wherein the chaise seat bottom frame includes an upper-leg-supporting portion and a lower-leg-supporting portion that are fixedly attached to each other, wherein the lower-leg-supporting portion supports an occupant's lower legs in an extended position relative to the occupant's upper legs; and a seatback frame supported by the base frame and movable relative to the base frame and the chaise seat bottom frame between an upright position and a reclined position, wherein movement of the seatback frame from the upright position to the reclined position causes corresponding and simultaneous movement of the chaise seat bottom frame vertically upward and horizontally forward relative to an aft end of the base frame from the first position to the second position, wherein the chaise seat bottom frame includes an elongated slot that receives a support member attached to the base frame, and wherein a surface defining the slot slides on the support member as the chaise seat bottom frame moves between the first and second positions.

11. A furniture member comprising:

a base frame;

a chaise seat bottom frame supported by the base frame and movable relative to the base frame between a first position and a second position, wherein the chaise seat bottom frame includes an upper-leg-supporting portion and a lower-leg-supporting portion that are fixedly attached to each other, wherein the lower-leg-supporting portion supports an occupant's lower legs in an extended position relative to the occupant's upper legs; and a seatback frame supported by the base frame and movable relative to the base frame and the chaise seat bottom frame between an upright position and a reclined position, wherein movement of the seatback frame from the upright position to the reclined position causes corresponding and simultaneous movement of the chaise seat bottom frame vertically upward and horizontally forward relative to an aft end of the base frame from the first position to the second position, wherein the chaise seat bottom frame is coupled to the base frame by a swing link that rotates relative to the base frame and the chaise seat bottom frame as the chaise seat bottom frame moves between the first and second positions.

12. The furniture member of claim 11, wherein the chaise seat bottom frame includes a first support rod rotatably coupled to the swing link, and wherein the base frame includes a second support rod rotatably coupled to the swing link.

13. A furniture member comprising:

a base frame;

a chaise seat bottom frame supported by the base frame and movable relative to the base frame between a first position and a second position, wherein the chaise seat bottom frame includes an upper-leg-supporting portion and a lower-leg-supporting portion that are fixedly attached to each other, wherein the lower-leg-supporting portion supports an occupant's lower legs in an extended position relative to the occupant's upper legs; and a seatback frame supported by the base frame and movable relative to the base frame and the chaise seat bottom frame between an upright position and a reclined position, wherein movement of the seatback frame from the upright position to the reclined position causes corresponding and simultaneous movement of the chaise seat bottom frame vertically upward and horizontally forward relative to an aft end of the base frame from the first position to the second position, wherein the furniture member further comprises a tensioning system that provides resistance to movement of the seatback frame between the upright and reclined positions and resistance to movement of the chaise seat bottom frame between the first and second positions.

14. The furniture member of claim 13, wherein:

the seatback frame is coupled to the base frame and the chaise seat bottom frame by a linkage that allows movement of the seatback frame between the upright and reclined positions, the linkage includes a first link, a second link, and a third link, the first link is fixedly attached to the seatback frame and rotatably attached to the chaise seat bottom frame, the second link is rotatably attached to the chaise seat bottom frame and includes a slot, the third link is rotatably attached to the base frame and rotatably attached to the first link, and the third link includes a protrusion that is slidably received in the slot of the second link.

15. The furniture member of claim 14, wherein the chaise seat bottom frame is coupled to the base frame by a plurality of swing links that rotates relative to the base frame and the chaise seat bottom frame as the chaise seat bottom frame moves between the first and second positions.

16. The furniture member of claim 15, wherein the chaise seat bottom frame is suspended from the base frame on the plurality of swing links such that vertical movement of the weight of the chaise seat bottom frame and the occupant provides a resisting force to balance a recline force of the seatback frame.

17. The furniture member of claim 16, wherein the horizontally forward movement of the chaise seat bottom frame while the seatback is moving toward the recline position also results in forward movement of a bottom end of the seatback while the seatback is moving toward the reclined position.

18. The furniture member of claim 17, wherein the seatback frame is able to be positioned at an infinite number of positions between the upright and reclined positions, and wherein the chaise seat bottom frame is able to be positioned at an infinite number of positions between the first and second positions.

* * * * *